US007490823B2

(12) United States Patent
Oishi et al.

(10) Patent No.: US 7,490,823 B2
(45) Date of Patent: Feb. 17, 2009

(54) PAPER SHEET STORAGE AND PAYOUT DEVICE

(75) Inventors: Taki Oishi, Tokyo (JP); Masaaki Egashira, Saitama (JP); Masaru Suwa, Saitama (JP)

(73) Assignee: Laurel Precision Machines Co., Ltd., Osaka (JP)

( * ) Notice: Subject to any disclaimer, the term of this patent is extended or adjusted under 35 U.S.C. 154(b) by 274 days.

(21) Appl. No.: 11/397,569

(22) Filed: Apr. 5, 2006

(65) Prior Publication Data

US 2006/0225986 A1 Oct. 12, 2006

(30) Foreign Application Priority Data

Apr. 8, 2005 (JP) ..... P2005-111922

(51) Int. Cl.
*B65H 5/22* (2006.01)
*B65H 39/14* (2006.01)

(52) U.S. Cl. ..... 271/3.01; 242/528

(58) Field of Classification Search ..... 271/3.14, 271/18, 216, 3.01, 4.01, 113, 4.04, 254; 242/528, 242/542.3, 412.1; 212/71–74
See application file for complete search history.

(56) References Cited

U.S. PATENT DOCUMENTS 3,733,036 A * 5/1973 Eitzenberger ..... 242/332.5
4,528,794 A * 7/1985 Thierstein ..... 53/118
4,953,843 A * 9/1990 Reist ..... 271/3.01
5,116,043 A * 5/1992 Jermann et al. ..... 271/213
5,735,516 A * 4/1998 Gerlier et al. ..... 270/60
6,371,368 B1 * 4/2002 Owens et al. ..... 235/379
6,371,473 B1 * 4/2002 Saltsov et al. ..... 271/3.01
6,565,082 B2 * 5/2003 Sasaki et al. ..... 271/216
6,568,673 B2 5/2003 Mochizuki et al.

(Continued)

FOREIGN PATENT DOCUMENTS

CN 1573820 2/2005

(Continued)

OTHER PUBLICATIONS

English Translation of Taiwanese Office Action and Search Report issued for Taiwanese Application No. 095112126, dated Apr. 14, 2008, 7 pages.

*Primary Examiner*—Patrick H Mackey
*Assistant Examiner*—Patrick D Cicchino
(74) *Attorney, Agent, or Firm*—Nixon & Vanderhye P.C.

(57) ABSTRACT

A paper sheet storage and payout device, which, by winding and unwinding tape between a first take-up drum on which the tape is wound from one end, and a second take-up drum on which the tape is wound from the other end, with paper sheets placed thereupon, stores and pays out paper sheets. A separation mechanism is provided on the payout side of the tape from the second take-up drum, and during payout separates the paper sheets from the wrapping peripheral region of the tape wrapped around the second take-up drum. This separation mechanism is provided with a separation member which separates paper sheets from the wrapping peripheral region, and a sliding portion which holds the separation member, and which slides so as to track the amount of tape wrapped around the second take-up drum by bring into contact with the wrapping peripheral region a guide roller.

20 Claims, 9 Drawing Sheets

U.S. PATENT DOCUMENTS

| | | | | |
|---|---|---|---|---|
| 6,669,136 | B2 * | 12/2003 | Niioka et al. | 242/528 |
| 2002/0096816 | A1 | 7/2002 | Sasaki et al. | |
| 2002/0096818 | A1 * | 7/2002 | Mochizuki et al. | 271/18 |
| 2002/0113160 | A1 | 8/2002 | Niioka et al. | |
| 2005/0017428 | A1 | 1/2005 | Ichikawa et al. | |
| 2007/0051844 | A1 * | 3/2007 | De Snoeck et al. | 242/528 |

FOREIGN PATENT DOCUMENTS

| | | |
|---|---|---|
| JP | 2002-160855 | 6/2002 |
| TW | 321322 | 11/1997 |
| TW | 367471 | 8/1999 |

* cited by examiner

PAPER SHEET STORAGE AND PAYOUT DEVICE

BACKGROUND OF THE INVENTION

1. Field of the Invention

This invention relates to a paper sheet storage and payout device, employed in paper currency processing equipment and similar, which stores and pays out paper sheets by means of the winding and unwinding of a tape.

Priority is claimed on Japanese Patent Application No. 2005-111922, filed Apr. 8, 2005, the content of which is incorporated herein by reference.

2. Description of Related Art

A conventional paper sheet storage and payout device of this type is described in Japanese Unexamined Patent Application, First Publication, No. 2002-160855. This paper sheet storage and payout device has a first take-up drum which winds the tape from one end, and a second take-up drum which winds the tape, with paper sheets placed thereupon, from the other end. This device, by rotating the second take-up drum in one direction, winds and stores paper sheets together with the tape onto the second take-up drum, and by rotating the second take-up drum in the opposite direction, pays out the paper sheets which had been stored in the second take-up drum together with the tape.

In the above paper sheet storage and payout device, at the time of paper sheet payout, the paper sheets must be reliably separated, in the direction of the tape being paid out, from the wrapping peripheral region of the tape which is wrapped around the second take-up drum. The payout starting position of the paper sheets changes with the amount of tape wrapped onto the second take-up drum. Hence in a conventional paper sheet storage and payout device, a separation member must be provided, in a manner enabling oscillation, such that this change can be tracked and separation performed, and the tip thereof is caused to make contact with the wrapping peripheral region of the tape by an impelling force.

However, if the separation member is merely enabled to oscillate as described above, when the amount of tape wrapped onto the second take-up drum changes, the amount of change in the angle of the separation member with respect to the wrapping peripheral region of the tape is large. As a result, there is the drawback that smooth separation of paper sheets from the wrapping peripheral region of the tape cannot be performed stably.

SUMMARY OF THE INVENTION

Hence an object of this invention is to provide a paper sheet storage and payout device which can stably perform smooth separation of paper sheets from the wrapping peripheral region of the tape.

In order to attain the above object, a paper sheet storage and payout device of this invention has:

a first take-up drum which winds tape from one end;

a second take-up drum which winds the tape with paper sheets placed thereupon from the other end, and stores and pays out paper sheets by causing winding and unwinding of the tape with the first take-up drum; and a separation mechanism which is provided on the tape payout side of the periphery of the second take-up drum, and includes a separation member which at the time of payout of paper sheets separates the paper sheets from the wrapping peripheral region of the tape wrapped around the second take-up drum, and a sliding portion which holds the separation member and slides tracking the amount of tape wrapped around the second take-up drum by causing a guide roller to be into contact with the wrapping peripheral region.

By means of this configuration, compared with cases in which the separation member is caused to oscillate, when the amount of tape wrapped around the second take-up drum changes, the amount of change in the angle of the separation member with respect to the wrapping peripheral region of the tape can be kept small by the sliding portion. Hence smooth separation of paper sheets from the wrapping peripheral region of the tape can be performed stably. Further, by having the sliding portion bring a guide roller into contact with the wrapping peripheral region of the tape, the diameter of which changes due to the amount wrapped around the second take-up drum, the amount of tape wrapped is tracked, so that sliding can be performed to track the amount of tape wrapped by means of a simple structure.

In a paper sheet storage and payout device of this invention, the sliding portion may slide in a direction which always intersects the tape payout direction from the second take-up drum, regardless of the amount of tape wrapped.

By means of this configuration, compared with a case in which sliding is possible in the direction parallel to the tape payout direction, when the amount of tape wrapped around the second take-up drum changes, the amount of change in the angle of the separation member with respect to the tape wrapping peripheral region can be kept small. Further, when the amount of tape wrapped around the second take-up drum changes, the amount of change in the distance from the tape payout starting position to the separation member can also be kept small. Hence smooth separation of paper sheets from the wrapping peripheral region of the tape can be performed stably.

In a paper sheet storage and payout device of this invention, the sliding portion may be impelled by an impelling member toward the center of the second take-up drum.

By means of this configuration, a simple structure can be employed to cause a guide roller to slide so as to be in contact with the wrapping peripheral region of the tape, the diameter of which changes with the amount wrapped.

In a paper sheet storage and payout device of this invention, the separation member may be supported by the sliding portion to enable oscillation and provided with a separation tip portion which is in contact with the wrapping peripheral region so as to separate paper sheets from the wrapping peripheral region, and a guide portion which guides paper sheets separated by the separation tip portion to the downstream side.

By means of this configuration, the separation member can oscillate, and so even when the guide roller undergoes minute vibration in the sliding direction due to the thickness of the paper sheets, the separation tip portion of the separation member can be held in contact with the wrapping peripheral region of the tape. Hence even in cases where the sliding portion is caused to slide by the guide roller, smooth separation of the paper sheets from the wrapping peripheral region of the tape can be performed still more stably. Further, because the separation member is provided with a guiding portion which guides paper sheets separated by the separation tip portion to the downstream side, separated paper sheets can be reliably guided to the downstream side.

In a paper sheet storage and payout device of this invention, the separation member may be impelled by an impelling member in a direction to cause contact of the separation tip portion with the wrapping peripheral region.

By means of this configuration, a simple structure can cause the separation tip portion of the separation member to be brought into contact with wrapping peripheral region of the tape, even when the sliding portion undergoes minute vibration.

In a paper sheet storage and payout device of this invention, a transport roller, in contact with and driven by the guide roller, and which rotates in the same direction as the second take-up drum to transport the paper sheets, may be provided in the separation mechanism.

By means of this configuration, the transport roller provided in the separation mechanism transports paper sheets; but because this transport roller is in contact with and driven in rotation by the guide roller, the rotation of the second take-up drum can be transmitted to the transport roller via the guide roller to transport paper sheets. Hence a driving source to drive the transport roller is unnecessary, so that the structure is simple and compact, and costs are low.

In a paper sheet storage and payout device of this invention, a separation promotion mechanism, which is in contact with the paper sheets closest to the payout side among the paper sheets wrapped around the second take-up drum, and which promotes the separation of the paper sheets from the wrapping peripheral region, may be provided in proximity to the separation mechanism and on the upstream side in the paper sheet payout direction, to enable motion which tracks the amount of paper sheets wrapped around the second take-up drum.

By means of this configuration, the separation promotion mechanism, provided in proximity to the separation mechanism and on the upstream side in the paper sheet payout direction, is in contact with the paper sheets c1osest to the payout side among the paper sheets wrapped around the second take-up drum, and promotes separation of these paper sheets from the wrapping peripheral region of the tape. Hence the smooth separation of paper sheets from the wrapping peripheral region of the tape by the separation mechanism provided on the downstream side can be performed still more stably.

In a paper sheet storage and payout device of this invention, the separation promotion mechanism may have a pair of separation promotion rollers, positioned on both sides of the tape, and inclined such that the further on the downstream side in the paper sheet payout direction, the narrower is the interval therebetween.

By means of this configuration, both sides of the paper sheets are gathered toward the tape side by the pair of separation promotion rollers, so that wrinkles are formed in the paper sheets the payout direction on the tape side, and on the tape side the paper sheets rise from the wrapping peripheral region of the tape, so that separation is promoted. Through such a simple structure, separation of paper sheets from the wrapping peripheral region of the tape can be promoted.

In a paper sheet storage and payout device of this invention, the separation promotion mechanism may have a base member which holds the pair of separation promotion rollers; an arm member, capable of oscillation, which supports the base member in a manner enabling oscillation; a base impelling member which impels the base member with respect to the arm member so as to bring the pair of separation promotion rollers into proximity with the second take-up drum; and an arm impelling member which impels the arm member in a direction so as to bring the pair of separation promotion rollers into proximity with the second take-up drum.

By means of this configuration, the base member, which holds the pair of separation promotion rollers, oscillates with respect to the arm member which supports the base member so as to enable oscillation in balance with the impelling force of the base impelling member, or, the arm member, which is capable of oscillation, oscillates in balance with the impelling force of the arm impelling member, so that the pair of separation promotion rollers is caused to move so as to track the amount of paper sheets wrapped around the second take-up drum. Thus through a simple structure, the pair of separation promotion rollers can be moved so as to track the amount of paper sheets wrapped around the second take-up drum.

In a paper sheet storage and payout device of this invention, the separation promotion mechanism may be provided with an auxiliary roller supported by the base member and which, through contact with the wrapping peripheral region, maintains an interval between the wrapping peripheral region and the base member.

By means of this configuration, when for example tape along is wound onto the second take-up drum without storing paper sheets, the positions of the pair of separation promotion rollers positioned on both sides of the tape do not change, and only the diameter of the wrapping peripheral region of the tape becomes large. Even when in this state, the auxiliary roller is in contact with the wrapping peripheral region and maintains the interval between the wrapping peripheral region and the base member. Hence contact between the tape and the base member can be prevented.

DETAILED DESCRIPTION OF THE INVENTION

Figure 1:
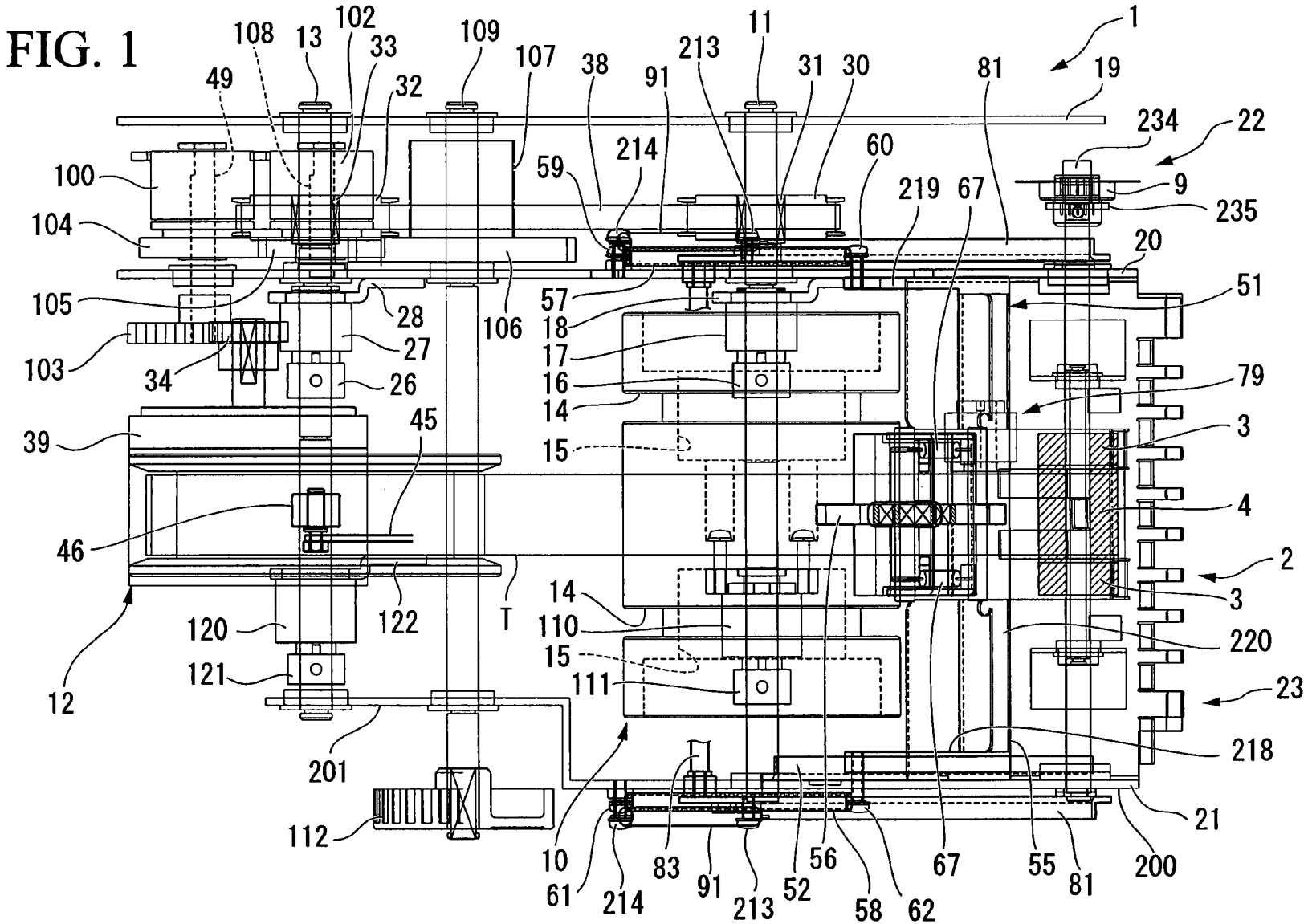
FIG. 1 is a transparent plane view showing the paper sheet storage and payout device according to an embodiment of the present invention.

An aspect of a paper sheet storage and payout device of this invention is explained below, referring to the drawings.

The paper sheet storage and payout device 1 of this aspect is used in a temporary storage portion and monetary type-specific storage portion of a paper currency receiving/dispensing unit which handles, as paper sheets, paper currency S. That is, the paper sheet storage and payout device 1 replaces a conventional paper sheet storage and payout device which accumulates and stores paper currency in a box-shape space, and pays out one bill at a time from the bottom or from the top. The paper sheet storage and payout device 1 of this aspect can handle international paper currency, which differ in size according to the monetary type, and transports and stores paper currency with the long-edge direction aligned in the transport direction.

Referring to FIG. 1, the paper sheet storage and payout device 1 is subdivided into a driving system space 22, enclosed between a vertically positioned side plate 19 and a support plate 20 provided parallel thereto, and an accumulation space 23, enclosed between the support plate 20 and a side plate 21 provided in opposition to and parallel to the side plate 19. The side plate 19 and support plate 20 are flat in shape. The side plate 21 has a step shape, on one side of which is formed a main plate portion 200 parallel to the side plate 19 and the support plate 20, and on the other side of which is formed a step plate portion 201, parallel to the side plate 19 and support plate 20, but closer to the support plate 20 than the main plate 200. The side plate 19, support plate 20 and side plate 21 are connected by a plurality of pins or similar, not shown.

Figure 2:
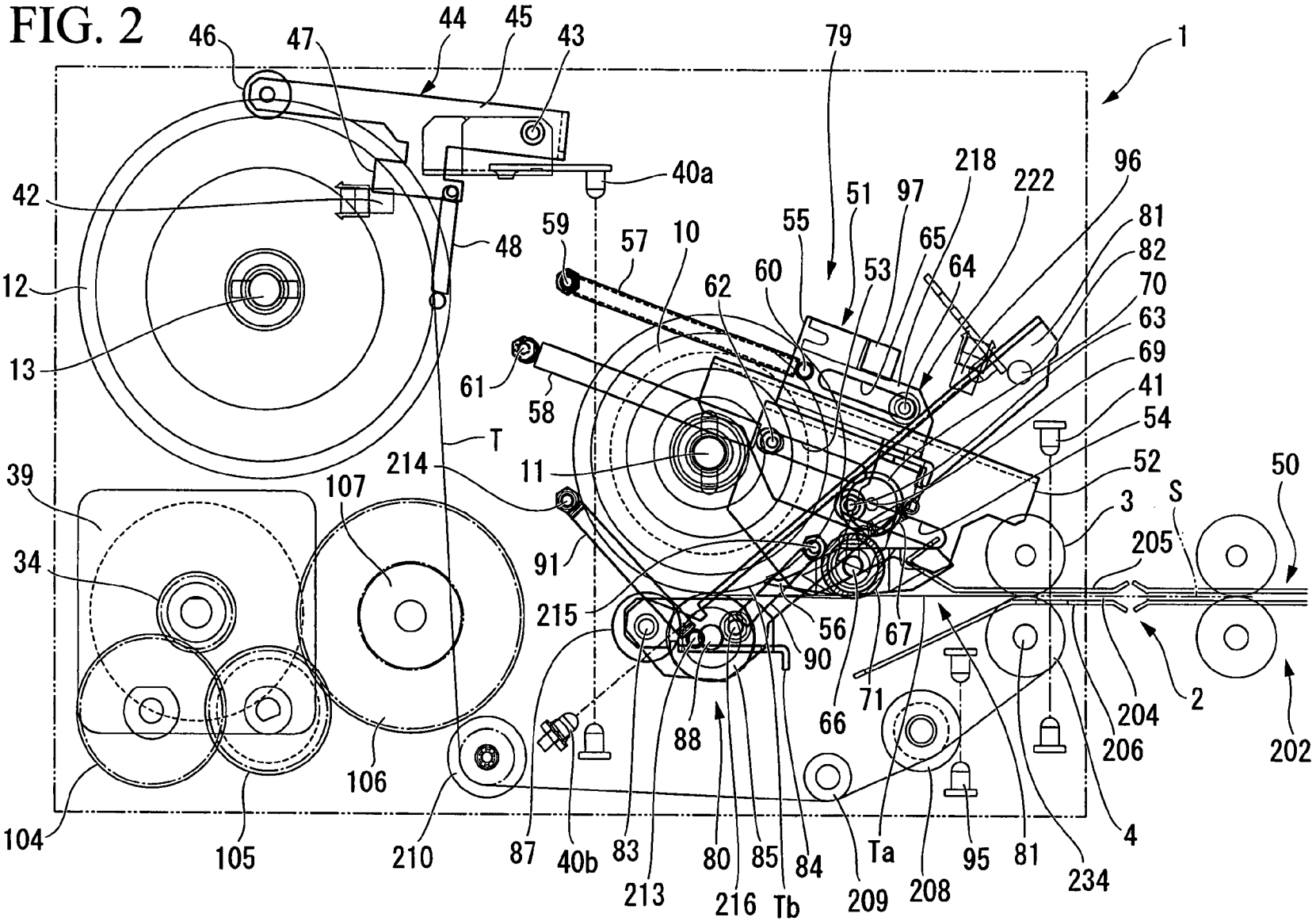
FIG. 2 is a transparent plane view showing the paper sheet storage and payout device according to the embodiment of the present invention, showing a state in which the tape is wound to some extent around a paper currency accumulation drum.
Figure 3:
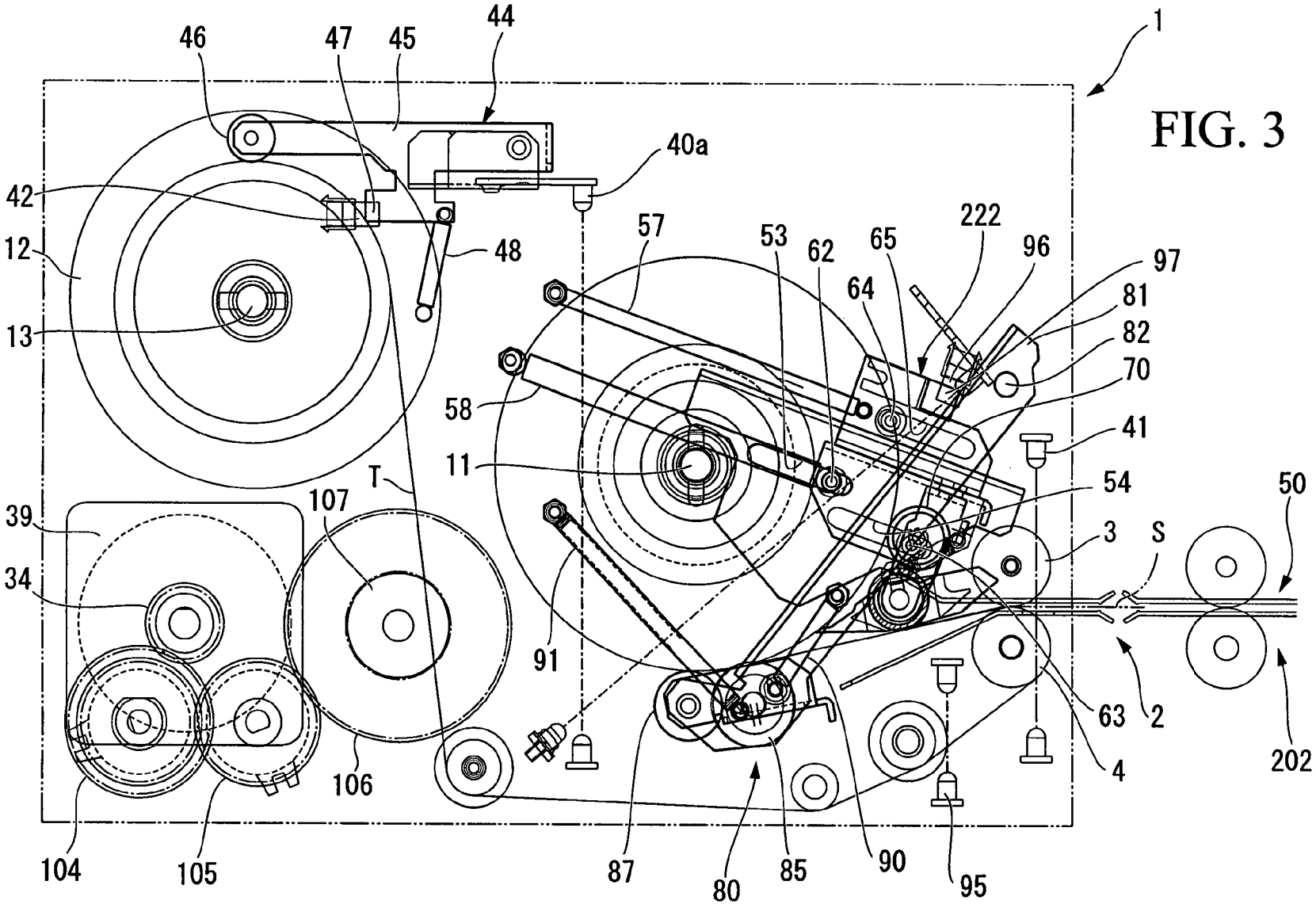
FIG. 3 is a transparent plane view showing the paper sheet storage and payout device according to the embodiment of the present invention, showing a state in which the tape is wound to the maximum limit around a paper currency accumulation drum.
Figure 4:
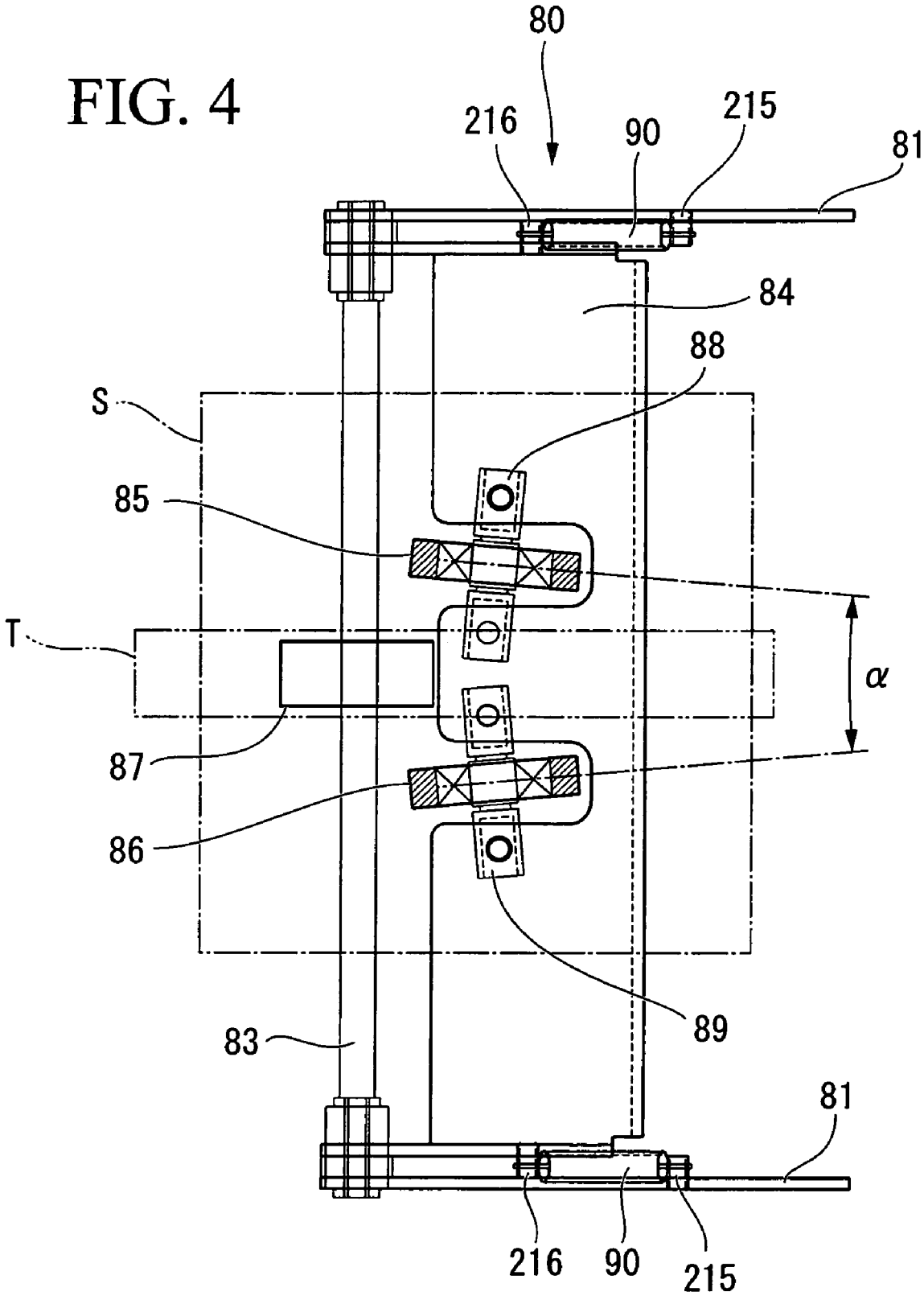
FIG. 4 is a transparent plane view showing the principal portions of the paper currency separation promotion mechanism in the paper sheet storage and payout device according to the embodiment of the present invention.
Figure 5:
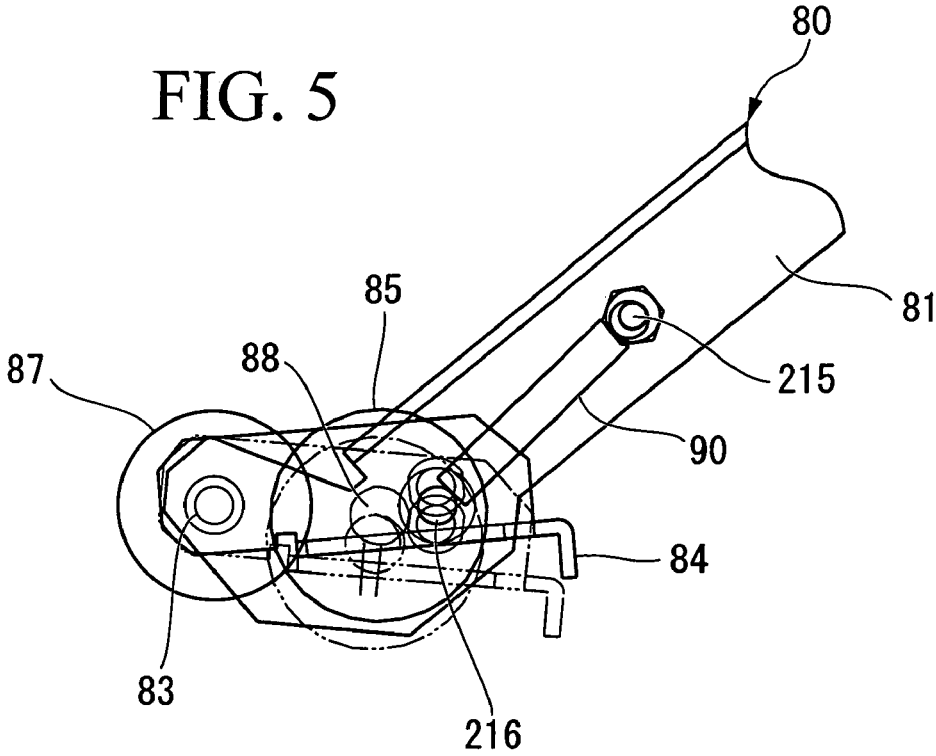
FIG. 5 is a transparent side view showing the principal portions of the paper currency separation promotion mechanism in the paper sheet storage and payout device according to the embodiment of the present invention.
Figure 6:
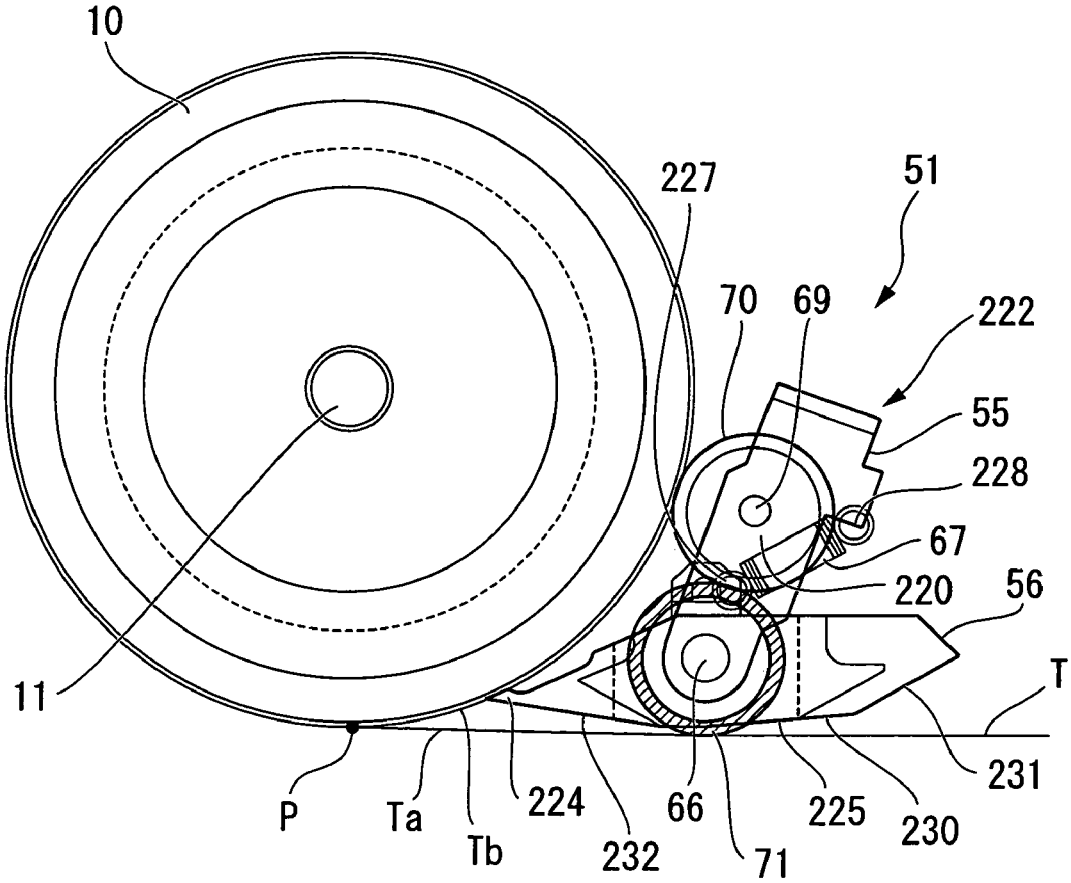
FIG. 6 is a transparent side view showing the principal portions of the paper currency separation mechanism in the paper sheet storage and payout device according to the embodiment of the present invention.

As shown in FIG. 2 and FIG. 3, in the accumulation space 23 is provided an inlet/outlet 2, connected to the transport path 50 on the side of the main unit 202 of the paper currency receiving/dispensing unit, at which paper currency S is received from and paid out to the main unit 202. This inlet/outlet 2 includes a pair of guide plate portions 205, 206 which, positioned horizontally above and below, form a passage portion 204 through which the paper currency S passes. Further, the inlet/outlet 2 has a pair of rollers, which are an upper roller 3 and a lower roller 4, provided in opposition above and below so that both protrude into the passage portion 204 between the guide plate portions 205, 206 and can make contact.

The lower roller 4 is suspended such that the tape T passes between this roller and the upper roller 3. One end of the tape T is extended and fixed to the paper currency accumulation drum (second take-up drum) 10, which is positioned toward the interior as seen from the inlet/outlet 2 and has a rotation shaft parallel to the lower roller 4. After this tape T passes over the lower roller 4, the transport direction is substantially reversed, and the three rollers 208, 209, 210 form a path. The other end of the tape T is fixed to a tape take-up drum (first take-up drum) having a rotation shaft parallel to that of the currency accumulation drum 10. The inlet/outlet region Ta of the tape T, connecting the paper currency accumulation drum 10 and lower roller 4, substantially follows the direction of extension of the passage portion 204 of the inlet/outlet 2. This lower roller 4 is driven by the traveling of the tape T, by means of contact tension of the tape T, and rotates. The upper roller 3 is also driven by the tape T, or by paper sheets placed upon and which move together with the tape T, and rotates. The rollers 208, 209, 210, provided to guide the tape T, are also rotated by the contact tension of the tape T.

The paper currency S is transported in a state of being separated, one bill at a time, from the transport path 50. The paper currency S is taken into the passage portion 204 between the pair of guide plates 205, 206 of the inlet/outlet 2, is placed by the upper roller 3 and lower roller 4 in the passage portion 204 such that the center position in the short-edge direction is placed on the tape T, and is transported together with the table T. Thereafter, the paper currency S is wrapped around the paper currency accumulation drum 10 together with the tape T, and by this means is accumulated and stored. Specifically, the paper currency S is placed on the side of the upper roller 3 of the tape T by the upper roller 3 and lower roller 4, and moves in straight-line fashion, together with the tape T, through the inlet/outlet region Ta. Then, at the boundary position between the inlet/outlet region Ta and the wrapping peripheral region Tb adjacent on the upstream side of the inlet/output region Ta in the rotation direction of the paper currency accumulation drum 10, the paper currency S is placed upon and wrapped by the tape T already wrapped, and enclosed therebetween. The wrapping peripheral region Tb is the most peripheral portion among the portion of the tape T already wrapped onto the paper currency accumulation drum 10. By this means, the paper currency S is accumulated on the paper currency accumulation drum 10 by being wrapped in succession, together with the tape T, on the paper currency accumulation drum 10.

Conversely, when the paper currency S accumulated on the paper currency accumulation drum 10 is being paid out from the paper currency accumulation drum 10, the portion in which the tape T and paper currency S overlap leaves the paper currency accumulation drum 10. The paper currency S is paid out together with the tape T, reaches the straight-line inlet/output region Ta from the wrapping peripheral region Tb, is separated from the tape T in the inlet/outlet 2, and is paid out to the transport path 50.

By rotating in the paper currency payout direction (the counterclockwise direction in FIG. 2 and FIG. 3), the tape take-up drum 12 winds the tape T from the side of the paper currency accumulation drum 10. At this time, the paper currency accumulation drum 10 also rotates in the same direction, and pays out the tape T and paper currency S. Also, the paper currency accumulation drum 10, by rotating in the direction opposite the above paper currency storage direction (the clockwise direction in FIG. 2 and FIG. 3), winds the tape T, on which had been placed paper currency S, on the side of the accumulation drum 10. At this time, the tape accumulation drum 12 also rotates in the same direction, and pays out tape T. In this way, by causing winding and unwinding of tape T between the tape take-up drum 12 and the paper currency accumulation drum 10, paper currency S is stored and paid out. Further, both ends of the tape T (the starting end and the finishing end) are attached to the outer surfaces of the paper currency accumulation drum 10 and the tape take-up drum 12, respectively, by attaching members, not shown.

The paper currency S is transported, oriented with the long direction along the transport direction. The paper currency accumulation drum 10 has a shaft length which is somewhat longer than the length of the shorter edge of the largest paper currency among the paper currency S to be handled, and is supported, in a manner enabling rotation, parallel to the upper roller 3 and lower roller 4, that is, positioned horizontally.

As shown in FIG. 1, on the outer surface of this paper currency accumulation drum 10, grooves 14 for a sensor light path, to detect the presence or absence of paper currency, form a ring in the circumferential direction. Depression portions 15, depressed with the shaft 11 as the center, are formed at both ends in the shaft direction of the paper currency accumulation drum 10.

The tape take-up drum 12 is supported, at a diagonal position from the inlet/output 2 in the accumulation space 23, by a shaft parallel to the rollers 3 and 4 in a manner enabling rotation thereabout.

This tape take-up drum 12 pays out tape T during accumulation of paper sheets S, and conversely, winds tape T which has been paid out during the paying out of accumulated paper sheets S. The tape take-up drum 12 winds only the tape T, the width of which is shorter than the width (shorter edge) of the paper sheets S, and so the shaft length may be shorter than that of the paper sheet accumulation drum 10; here, the shaft length is substantially the same as the width of the tape T.

In this aspect, a paper currency separation portion 79 is provided near the paper currency accumulation drum 10. When paper currency S is paid out from the paper currency accumulation drum 10, the paper currency separation portion 79 causes the portion of the tape T pressing the paper currency S on the outside to reach to the inlet/outlet region Ta, and the paper currency S which had been pressed by this portion is separated from the wrapping peripheral region Tb and caused to reach the inlet/outlet region Ta, together with the tape T. The wrapping peripheral region Tb is the portion of the tape T which is not yet wrapped around the paper currency accumulation drum 10. That is, this paper currency separation portion 79 is primarily utilized when paying out paper currency S which has been accumulated in the paper currency accumulation drum 10, and causes the paper currency S paid out to be reliably separated from the paper currency accumulation drum 10.

This paper currency separation portion 79 has a paper currency separation promotion mechanism 80 and a paper currency separation mechanism 51. The paper currency separation promotion mechanism 80 is on the upstream side in the direction of payout of the paper currency S, makes contact with the paper currency S closest to the payout side among the paper currency S wrapped around the paper currency accumulation drum 10, and promotes separation of this paper currency S from the wrapping peripheral region Tb. The paper currency separation mechanism 51 is in a position immediately on the downstream side in the payout direction of the paper currency S, is provided on the payout side of the tape T from the paper currency accumulation drum 10, that is, on the side of the lower roller 4, and separates the paper currency S from the wrapping peripheral region Tb of the paper currency accumulation drum 10, causing the paper currency S to reach the inlet/outlet region Ta together with the tape T.

The paper currency separation promotion mechanism 80 has a pair of shafts 82 parallel to the paper currency accumulation drum 10, as shown in FIG. 1 through FIG. 5. These shafts 82 are positioned so as to be coaxial in the support plate 20 and side plate 21. These shafts 82 are provided on the upper side of the inlet/outlet region Ta of the tape T, as seen from the direction of the drum shaft line.

The paper currency separation promotion mechanism 80 has a pair of arm members 81, supported on the side of the accumulation space 23 opposite the pair of shafts 82, so as to enable oscillation of the center of the shafts 82, and a shaft 83, parallel to the shafts 82, which connects the end portions on the side opposite these shafts 82. The pair of arm members 81 are parallel, and when seen from the drum shaft line direction, extend to the fore and downward to a position beyond the inlet/outlet region Ta of the tape T.

Further, the paper currency separation promotion mechanism 80 has a base member 84, supported by the shaft 83 in a state of extension between the arm members 81, to enable oscillation about the shaft 83. That is, this base member 84 is supported, in a manner enabling oscillation, by the arm members 81, which are capable of oscillation.

The base member 84 has a pair of shafts 88, 89 on the outside, that is, the lower side, of the boundary position between the outermost periphery of the wrapping peripheral region Tb of the tape T wrapped around the paper currency accumulation drum 10 and the inlet/outlet region Ta, so as to enclose the tape T on both sides in the direction of the shaft line of the paper currency accumulation drum 10. On the shaft 88 is provided a separation promotion roller 85, and on the shaft 89 is provided a separation promotion roller 86, both freely rotatable. That is, the pair of separation promotion rollers 85, 86 are held by the base member 84, via the shafts 88, 89. Here, when seen from the drum radial direction, the pair of shafts 88, 89 are inclined such that the opposing sides are positioned on the downstream side in the payout direction during payout of paper currency S by the paper currency accumulation drum 10. As a result, the pair of separation promotion rollers 85, 86 are inclined uniformly such that the further downstream in the payout direction during payout of paper currency S by the paper currency accumulation drum 10, that is, the closer to the side of the inlet/outlet 2, the narrower is the interval therebetween. The angle of inclination of the shafts 88, 89 is set such that the angle of intersection a of lines perpendicular to the shaft center lines is approximately 10°. The pair of separation promotion rollers 85, 86 are placed in positions such that the minimum interval therebetween is broader than the width of the tape T, and the shafts move away from the tape T on both outer sides of the tape T; that is, there is no contact.

The shaft 83 connects the pair of arm members 81, and supports the base member 84. On the shaft 83 is provided an auxiliary roller 87, the position on the shaft line direction of which is adjusted to the center of the tape T, and freely rotating about the shaft 83. The auxiliary roller 87 is provided so as to project further toward the side of the paper currency accumulation drum 10 than the base member 84 as seen from the drum shaft line direction. This auxiliary roller 87 is of width smaller than the tape T, so as to be positioned further inward than the two edges of the tape T. The auxiliary roller 87 is in contact with the wrapping peripheral region Tb of the table T and maintains an interval between this wrapping peripheral region Tb and the base member 84. That is, when a large amount of only the tape T is wrapped around the paper currency accumulation drum 10, and the separation promotion rollers 85, 86 do not move in the radial direction of the paper currency accumulation drum 10, this auxiliary roller 87, by making contact with the tape T and causing the base member 84 to move tracking the outer diameter of the tape T, prevents direct contact of the base member 84 with the tape T.

Latch pins 213 are installed on the respective sides of the base member 84 at which the pair of arm members 81 are located. Latch pins 214 are installed in the support plate 20 and side plate 21, on the side of the paper currency accumulation drum 10 opposite the latch pins 213. Between the latch pins 213 and the patch pins 214, respectively on the same sides, are installed tension springs (arm impelling members) 91. These tension springs 91 impel the pair of arm members 81 in the direction bringing the pair of separation promotion rollers 85, 86 into proximity with the paper currency accumulation drum 10 (the clockwise direction in FIG. 2 and FIG. 3).

Latch pins 215 are installed in the intermediate positions of the pair of arm members 81. Latch pins 216 are installed in the base member 84, on the sides of the arm members 81, opposite the shaft 83. Tension springs (base impelling members) 90 are installed between the latch pins 215 and the latch pins 216 on each of the same sides. These tension springs 90 impel the base member 84 in the direction such that the pair of separation promotion rollers 85, 86 are brought into proximity with the paper currency accumulation drum 10 relative to the pair of arm members 81 (in the counterclockwise direction in FIG. 2 and FIG. 3).

By means of the impelling force of the tension springs 90 and 91, the pair of separation promotion rollers 85, 86 is brought into contact with both sides in the short-edge direction of the paper currency S held by the tape in the center position in the short-edge direction, closest to the payout side, among the paper currency S wrapped around the paper currency accumulation drum 10. When, due to a change in the amount of paper currency wrapped around the paper currency accumulation drum 10, the position in the radial direction of the paper currency accumulation drum 10 of the paper currency S closes to the payout side changes, the arm member 81 primarily oscillates to track this change in position. That is, the paper currency separation promotion mechanism 80 can move in the radial direction of the paper currency accumulation drum 10 to track the amount of paper currency wrapped around the paper currency accumulation drum 10. Moreover, the paper currency separation promotion mechanism 80 is in contact with the paper currency S at the boundary position between the wrapping peripheral region Tb of the tape T and the inlet/outlet region Ta in the payout direction, regardless of the amount of paper currency.

In this paper currency separation promotion mechanism 80, when the paper currency S closest to the payout side among the paper currency S wrapped around the paper currency accumulation drum 10 moves together with payout of the tape T, the separation promotion rollers 85, 86 gather the paper currency S on both sides toward the tape T. As a result, wrinkles are formed in the paper currency S along the payout direction on the side of the tape T, the side of the tape T rises from the wrapping peripheral region Tb of the tape T, and separation is promoted.

The paper currency separation mechanism 51 has a guide plate 52, mounted directly using screws or similar, not shown, onto the accumulation space 23 side of the side plate 21, in a state extending between the shaft 11 and inlet/outlet 2, as shown in FIG. 1 through FIG. 3 and FIG. 6. This guide plate 52 is a plate member having a cross-sectional "L" shape, bent on the side of the accumulation space 23 from the side plate 21. At an intermediate position on this guide plate 52, a parallel pair of guide grooves 53, 54, inclined so as to be positioned lower in moving toward the side of the inlet/outlet 2, are formed, with the upper-side guide groove 53 shifted closer to the side of the shaft 11 than the lower-side guide groove 54. These guide grooves 53, 54 are provided on the side of the paper currency accumulation drum 10 from the tape T inlet/outlet region Ta, that is, on the upper side.

Further, the paper currency separation mechanism 51 has a sliding pin 62 which is joined with the guide groove 53 of the guide plate 52 to enable sliding, a sliding pin 63 which is joined with the guide groove 54 of the guide plate 52 to enable sliding, and a base member 55 which slides in the direction of extension of the guide grooves 53, 54 between the support plate 20 and the side plate 21. In this base member 55 is formed a slide groove 65 so as to extend along the guide grooves 53, 54 of the guide plate 52. This slide groove 65 is joined to a guide pin 64, installed in the support plate 20, so as to enable relative sliding. This base member 55 performs stable sliding by means of the guide grooves 53, 54, the slide groove 65, the slide pins 62, 63, and the guide pin 64.

The base member 55 is positioned, overall, on the side of the paper currency accumulation drum 10 from the inlet/outlet region Ta of the tape T, that is, on the upper side. The base member 55 has base portions 218 and 219, and a connecting portion 220 which joins these. The base portion 218 is positioned in proximity to the side plate 21 on the side of the accumulation space 23, and has slide pins 62, 63 which are joined with the guide grooves 53, 54 in the guide plate 52. The base portion 219 is positioned in proximity to the support plate 20 on the side of the accumulation space 23, and has a guide groove 65, along which the guide pin 64 provided in the support plate 20 slides and is guided. The connecting portion 220 is provided so as to protrude on the side of the inlet/output region Ta of the tape T on the edges of the base portions 218, 219, on the side opposite the paper currency accumulation drum 10, as seen from the drum shaft line direction.

Further, the paper currency separation mechanism 51 has a shaft 69, parallel to the paper currency accumulation drum 10, in the portion provided within the base portions 218, 219 as seen from the direction of the drum shaft line of the connecting portion 220 of the base member 55. This shaft 69 is provided with a guide roller 70, supported so as to enable rotation about the center of the shaft 69. This guide roller 70 protrudes on the side of the paper currency accumulation drum 10 from the connecting portion 220, and is positioned to match the wrapping peripheral region Tb in the direction of the drum shaft line. The above-described slide pins 62 and 63, guide pin 64, base member 55, shaft 69, and guide roller 70 make up a sliding portion 222 which slides relative to the paper currency accumulation drum 10.

The paper currency separation mechanism 51 has a latch pin 60, installed in the base portion 219 of the base member 55 on the side of the support plate 20; a latch pin 59, installed on the extended line drawn along the direction of extension of the slide groove 65 from the latch pin 60, at a position beyond the paper currency accumulation drum 10; and, a tension spring (impelling member) 57, installed between these latch pins 59 and 60. The paper currency separation mechanism 51 further has a slide pin 62, installed in the base portion 218 of the base member 55 on the side of the side plate 21; a latch pin 61, installed on the extended line drawn along the direction of extension of the guide grooves 53, 54 from the slide pin 62, at a position beyond the paper currency accumulation drum 10; and, a tension spring (impelling member) 58, installed between these latch pin 61 and slide pin 62.

By this means, the base member 55, that is, the sliding portion 222, is impelled by the tension springs 57, 58 toward the center direction of the paper currency accumulation drum 10. As a result, the sliding portion 222 brings the guide roller 70, held by the base member 55, into contact with the outer periphery of the paper currency accumulation drum 10 if tape T is not wrapped around the paper currency accumulation drum 10, and into contact with the wrapping peripheral region Tb of the tape T if tape T is wrapped around the paper currency accumulation drum 10. Hence the sliding portion 222 slides to track the size of the outer periphery, which changes with the amount of tape T and the amount of paper currency S wrapped around the paper currency accumulation drum 10. That is, the guide roller 70 performs positioning of the base member with respect to the outer periphery of the paper currency accumulation drum 10 and the wrapping peripheral region Tb of the tape T. As a result, the base member 55 slides along the guide grooves 53, 54 according to the amount of tape T and paper currency S wrapped around the paper currency accumulation drum 10. The guide roller 70 is in contact with and driven by the paper currency accumulation drum 10 or tape T and rotates.

In the state in which tape T and paper currency S are not wrapped around the paper currency accumulation drum 10, the base member 55 is positioned closest to the shaft 11 which is the center of the paper currency accumulation drum 10 along the guide grooves 53, 54 of the guide plate 52. In the state in which tape T and paper currency S are sufficiently wrapped around the paper currency accumulation drum 10, the base member 55 is positioned along the guide grooves 53, 54 of the guide plate 52, on the side furthest from the shaft 11 which is the center of the paper currency accumulation drum 10. In the base member 55 is provided a sensor blocking portion 97. Through the blocking of detection light by the sensor blocking portion 97, the optical accumulation portion full detection sensor 96 detects the fact that, during accumulation of paper currency in the paper currency accumulation drum 10, paper currency S has been collected to the point of fullness. That is, when the outer periphery of the paper currency accumulation drum 10 gradually becomes larger due to the tape T and paper currency S wrapped during paper currency accumulation on the paper currency accumulation drum 10, the sliding portion 222 of the paper currency separation mechanism 51, which includes a sensor shielding portion 97 which tracks this change, slides to the side of the inlet/outlet 2 in the radial direction of the paper currency accumulation drum 10. The accumulation portion full detection sensor 96 detects the fact that the paper currency accumulation drum 10 has accumulated paper currency S until the drum is full, by detecting the sensor blocking portion 97.

In addition, the paper currency separation mechanism 51 has, in the portion which protrudes from the base portions 218, 219 as seen from the drum shaft line direction of the connecting portion 220 of the base member 55, a shaft 66 parallel to the paper currency accumulation drum 10. On this shaft 66 is supported a separator (separation member) 56 so as to enable oscillation. That is, the separator 56 is held by the sliding portion 222 so as to enable oscillation. This separator 56 is positioned in the space with approximately an acute angle shape formed by the wrapping peripheral region Tb of the tape T wrapped around the paper currency accumulation drum 10 and the inlet/outlet region Ta. The separator 56 has a separation tip portion 224, formed at the edge on the side of the paper currency accumulation drum 10, and a guide portion 225, extending along the inlet/outlet region Ta of the tape T from this separation tip portion 224. The separation tip portion 224 forms an acute angle as seen from the drum shaft line direction, and one face thereof is connected to the guide portion 225.

The paper currency separation mechanism 51 has a latch pin 227 installed in the separator 56, a latch pin 228 installed in the base member 55, and a tension spring (impelling member) 67 interposed therebetween. By means of the tension spring 67, the paper currency separation mechanism 51 impels the separation tip portion 224 to the outer periphery of the paper currency accumulation drum 10 when tape is not wrapped around the drum, and when tape is wrapped around the drum, impels the separation tip portion 224 in the direction (the clockwise direction in FIG. 6) to make contact with the wrapping peripheral region Tb of the tape T. As a result, when tape is wrapped around the paper currency accumulation drum 10, the separator 56 causes the separation tip portion 224 to always make contact with the wrapping peripheral region Tb of the tape T. That is, when tape T is wrapped around the paper currency accumulation drum 10 together with paper currency S, slight differences in diameter occur where paper currency S is and is not present. The separator 56 is held by the sliding portion 222 such that the separator 56 is positioned with respect to the wrapping peripheral region Tb of the tape T by the guide roller 70 in contact, so that the position of the separator 56 also changes minutely during movement. By making the separator 56 capable of oscillation, this movement is absorbed. The guide roller 70 and separator 56 are of a width such that they can be placed within the width of the tape T in the drum shaft line direction.

By means of this configuration, while paying out paper currency S from the paper currency accumulation drum 10, when the portion of the tape T which had been constraining paper currency S reaches the inlet/outlet region Ta, even if the tip of the paper currency S which had been constrained by this portion attempts to move while adhering without change to the wrapping peripheral region Tb of the tape T, the separation tip portion 224 of the separator 56 which is in contact with the wrapping peripheral region Tb acts to peel away and separate the paper currency S from the wrapping peripheral region Tb of the tape T. The paper currency S, having been separated in this manner by the separation tip portion 224, is guided so as to move to the side of the inlet/outlet 2, that is, to the downstream side, by the guide portion 225 opposing the inlet/outlet region Ta of the tape T. In this way, the separator 56 which actually separates and guides the paper currency S is supported, in a manner enabling oscillation, by the base member 55, which slides along the guide grooves 53, 54 according to the amount of tape T and paper currency S wrapped around the paper currency accumulation drum 10.

The guide portion 225 has an intermediate guide surface 230 oriented along the inlet/outlet region Ta of the tape T, and an intake-side guide surface 231 on the side of the inlet/outlet 2 from the intermediate guide surface 230, and inclined so as to retreat from the inlet/outlet region Ta in moving toward the inlet/outlet 2. The guide portion 225 has a payout-side guide surface 232, on the side of the paper currency accumulation drum 10 from the intermediate guide surface 230, which is inclined so as to retreat from the inlet/outlet region Ta in moving toward the paper currency accumulation drum 10. The inclination angle relative to the intermediate guide surface 230 is larger for the intake-side guide surface 231 than for the payout-side guide surface 232. The payout-side guide surface 232 smoothly guides the paper currency S separated from the paper currency accumulation drum 10 by the separation tip portion 224 between the separator 56 and the inlet/outlet region Ta of the tape T to the inlet/outlet 2. The intake-side guide surface 231 smoothly guides even paper currency S which tends to fold or curl and has been transported from the inlet/outlet 2 between the separator 56 and the inlet/outlet region Ta of the tape T, and to the paper currency accumulation drum 10.

In the paper currency separation mechanism 51, the transport roller 71 to enable rotation by the shaft 55, which is the center of oscillation with respect to the base member 55 of the separator 56.

This transport roller 71 is always caused to be in contact with the guide roller 70, and a portion thereof is caused to protrude from the intermediate guide surface 230 to the side of the inlet/outlet region Ta of the tape T, and can make contact with tape T in this inlet/outlet region Ta, or with paper currency S placed on the tape T in this inlet/outlet region Ta. By this means, when the paper currency accumulation drum 10 rotates, the guide roller 70 in contact therewith is driven in rotation in the opposite direction, and the transport roller is driven in rotation in the direction opposite that of the guide roller 70. As a result, the transport roller 70 rotates in the same direction as the paper currency accumulation drum 10. Hence during paper currency payout, the transport roller 71, while holding paper currency S separated from the wrapping peripheral region Tb of the tape T on the paper currency accumulation drum 10 with the inlet/outlet region Ta of the tape T, transports the paper currency S to the side of the inlet/outlet 2, that is, to the downstream side. During paper currency storage, the transport roller 71, while holding the paper currency S sent from the inlet/outlet 2 with the inlet/outlet region Ta of the tape T, transports the paper currency S to the side of the paper currency accumulation drum 10, that is, to the downstream side.

Figure 8:
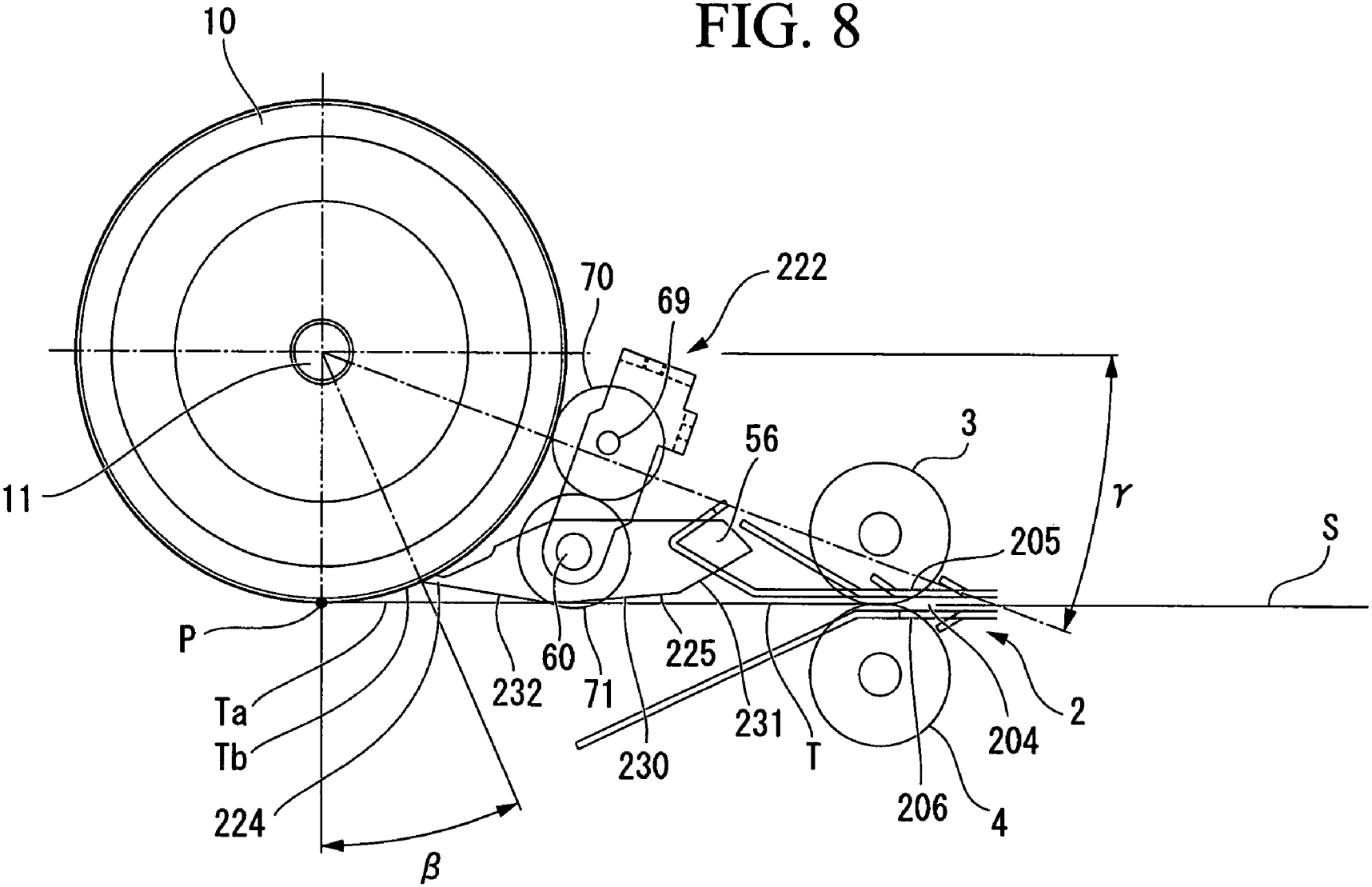
FIG. 8 is a transparent side view showing the paper currency accumulation drum side in the paper sheet storage and payout device according to the embodiment of the present invention, showing a state in which the tape is paid out to the maximum limit from the paper currency accumulation drum side.
Figure 9:
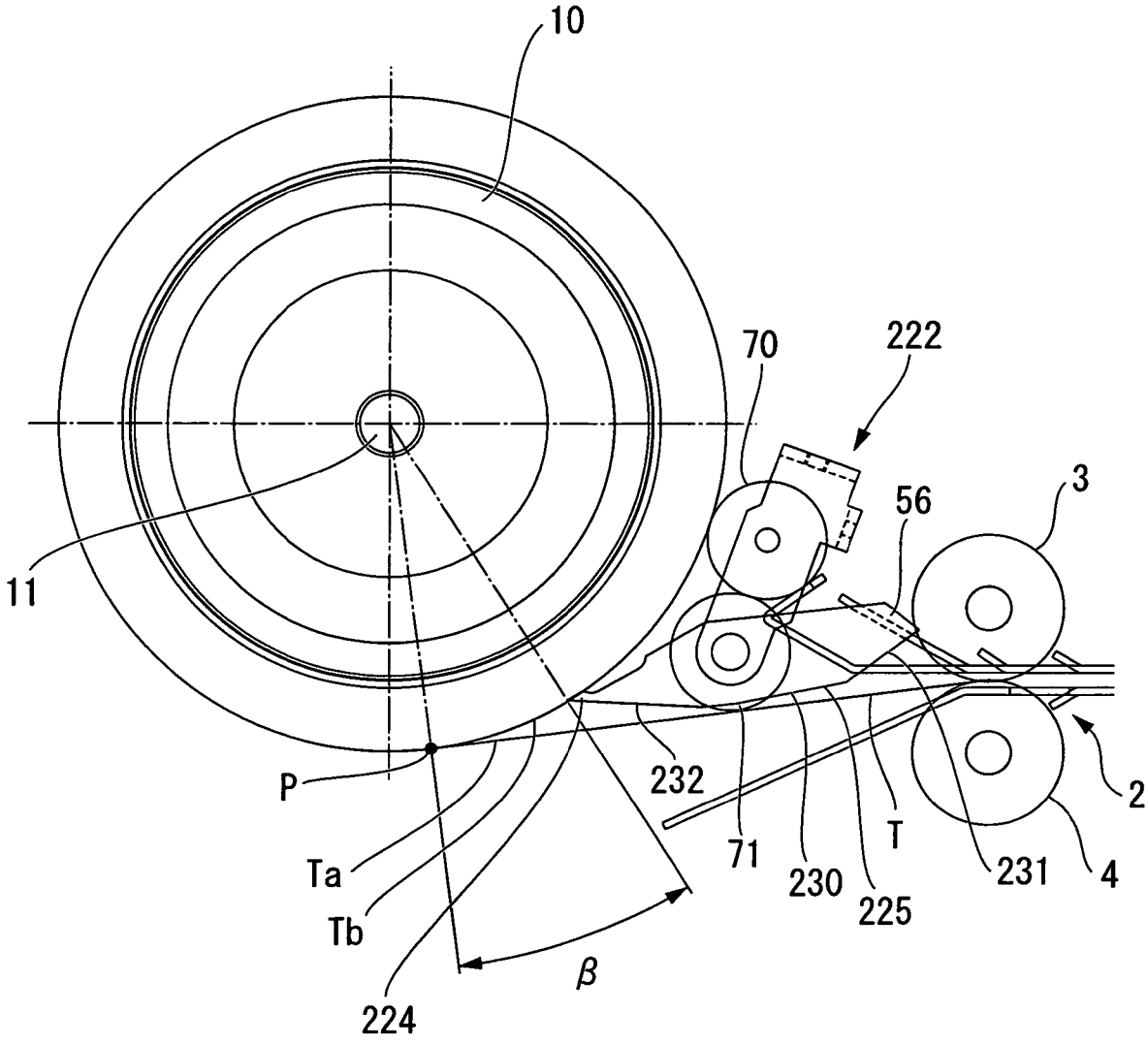
FIG. 9 is a transparent side view showing the paper currency accumulation drum side in the paper sheet storage and payout device according to the embodiment of the present invention, showing a state in which the tape is wound partway onto the paper currency accumulation drum.
Figure 10:
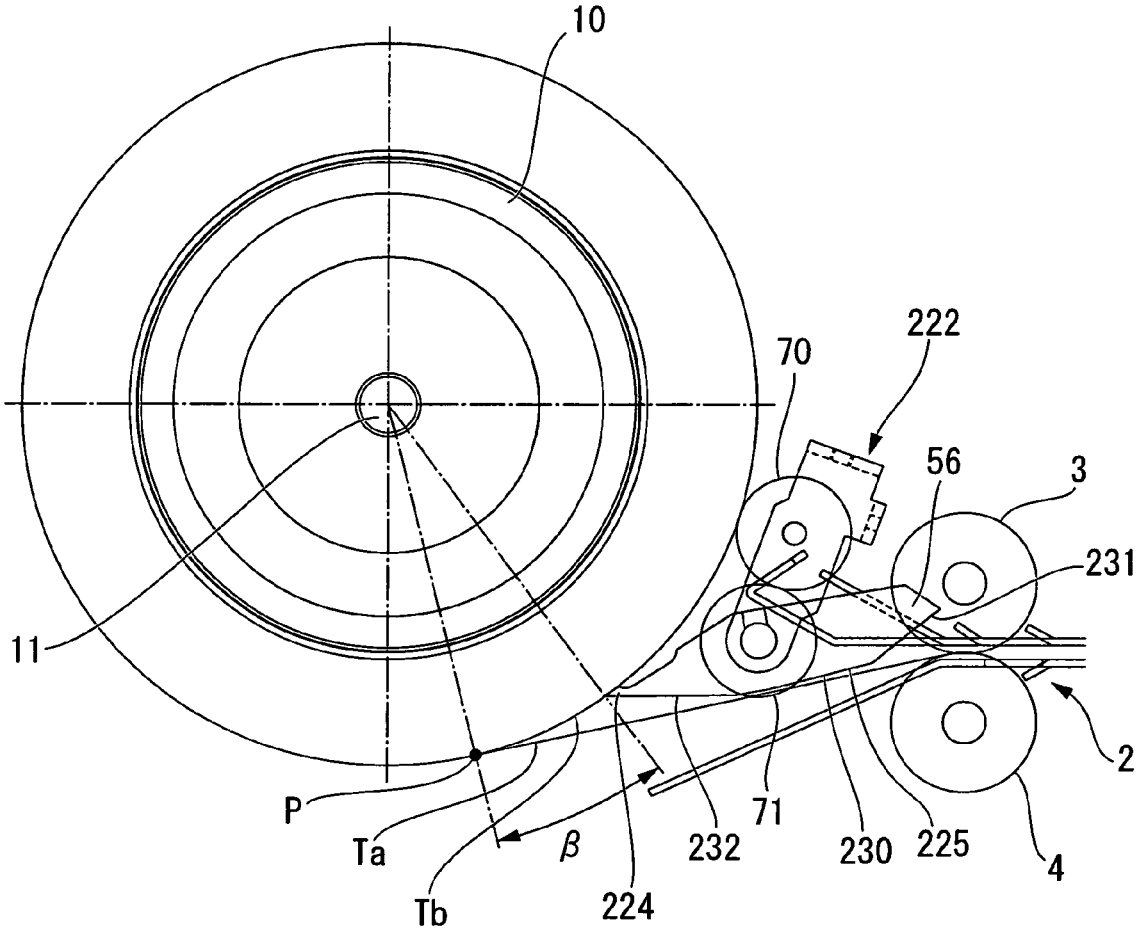
FIG. 10 is a transparent side view showing the paper currency accumulation drum side in the paper sheet storage and payout device according to the embodiment of the present invention, showing a state in which the tape is wound to the maximum limit onto the paper currency accumulation drum.

As shown in FIG. 8, when in a state in which the tape T is paid out to the greatest extent from the paper currency accumulation drum 10, the inlet/outlet region Ta of the tape T coincides with the line of extension of the inlet/outlet 2. Further, when tape T and paper currency S are wrapped around the paper currency accumulation drum 10, the payout starting position P which is the boundary between the inlet/outlet region Ta of the tape T and the wrapping peripheral region Tb moves gradually to the side of the inlet/outlet 2 in the direction of the line of extension of the inlet/outlet 2 according to the amount wrapped, while gradually retreating in the radial direction from the paper currency accumulation drum 10, and the inlet/outlet region Ta of the tape T becomes inclined such that the inlet/outlet 2 side is the upper side, as shown in FIG. 9 and FIG. 10. On the other hand, the sliding portion 222, which moves along the guide grooves 53, 54, slides so as to be positioned lower, the further toward the inlet/outlet 2, with respect to the horizontal line of extension of the inlet/outlet 2. As a result, the sliding portion 222 slides in a direction which always intersects the payout direction of tape T from the paper currency accumulation drum 10, that is, the direction of extension of the inlet/outlet region Ta, regardless of the amount of tape T and paper currency S wrapped around the paper currency accumulation drum 10.

Figure 7B:
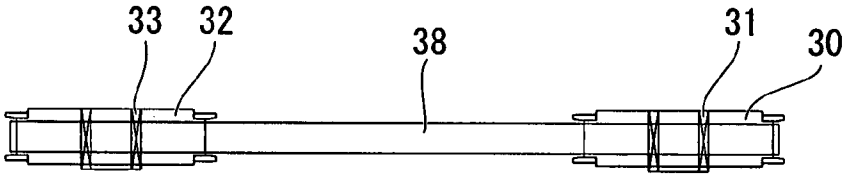
FIG. 7A and FIG. 7B are a transparent side view and a transparent plane view showing the driving system in the paper sheet storage and payout device according to the embodiment of the present invention.
Figure 7A:
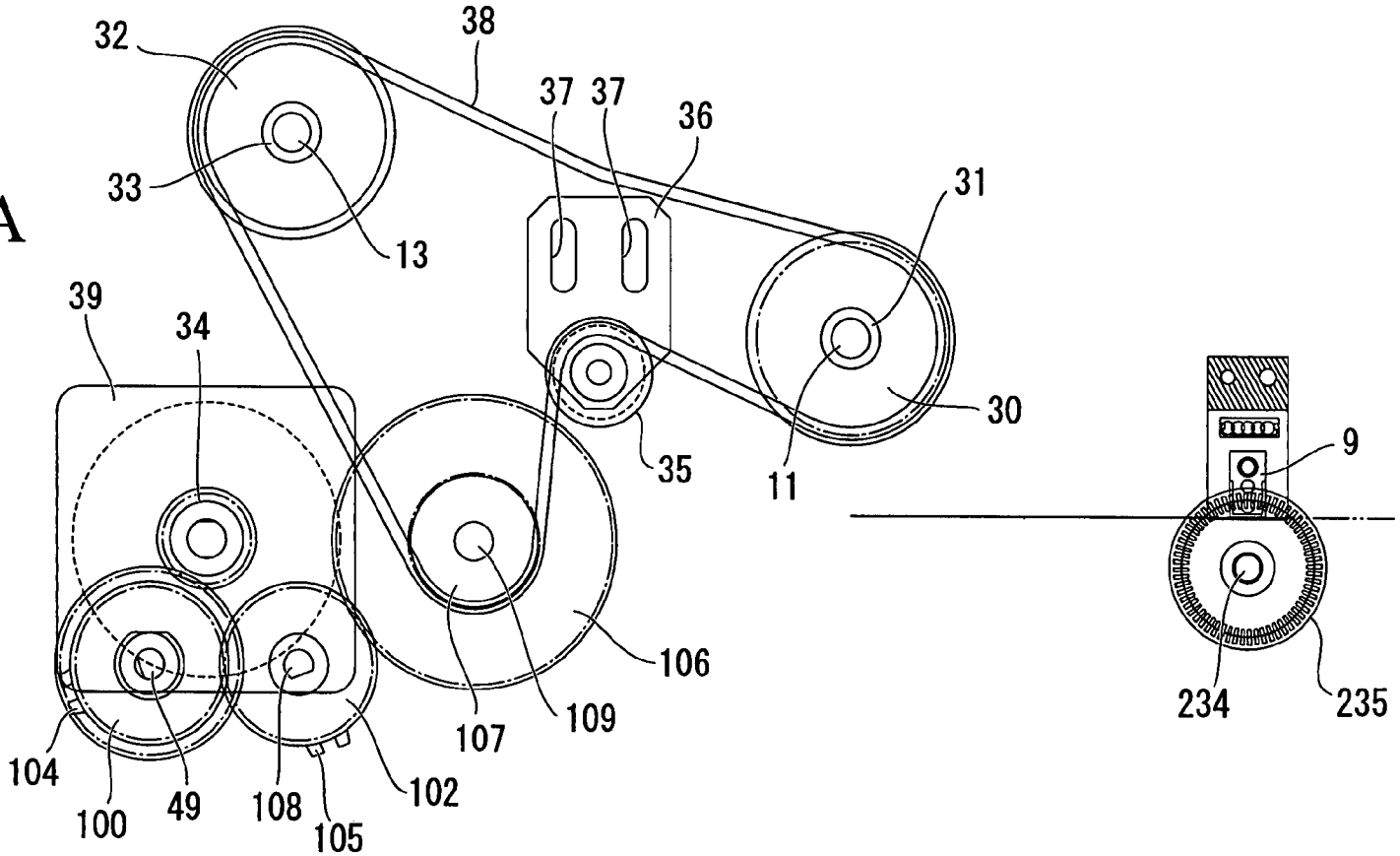

Next, the driving system is explained, referring mainly to FIG. 1, FIG. 7A, and FIG. 7B.

The shaft 11 is supported by the side plate 19, support plate 20 and by the main plate portion 200 of the side plate 21, in an orientation perpendicular to these, so as to enable rotation. A torque limiter 17, installed on the support plate 20 via the mounting plate 18, passes through the shaft 11, and a joining member 16 joined to the torque limiter 17 is fixed in place. That is, the torque limiter 17 is provided between the joining member 16 fixed to the shaft 11, and a mounting plate 18 which is a non-rotatable portion. The torque limiter 17 and joining member 16 are positioned within a portion of the depression portions 15 of the paper currency accumulation drum 10.

In another depression portion 15 of the paper currency accumulation drum 10 is mounted a torque limiter 110, in a state of being passed through the shaft 11. A joining member 111 joined to the torque limiter 110 is fixed in place, in a state of placement in the depression portion 15.

The torque limiter 17 allows the shaft 11 to rotate only upon receiving either rotational torque from the motor 39 during paper currency storage, or rotational torque due to tension of the tape T caused by winding onto the tape take-up drum 12 during paper currency payout. That is, the torque limiter 17 does not allow the shaft 11 to rotate, except when necessary during storage or payout. When the outer diameters of the paper currency accumulation drum 10 around which are wrapped the tape T and paper currency S and of the tape take-up drum 12 change considerably and the difference between the respective rotation speeds is large, the torque limiter 110 causes slipping to occur between the shaft 11 and the paper currency accumulation drum 10, absorbing the difference in speed. By this means, a difference in rotation speed due to changes in outer diameter can be absorbed without performing special gear ratio modifications or similar, and the tension of the tape T can be kept constant; moreover, excessive loads are not applied to the tape T even during sudden impacts due to paper currency jams and similar.

The shaft 13 is supported by the side plate 19, support plate 20 and by the step plate portion 201 of the side plate 21, in an orientation perpendicular to these, so as to enable rotation. A torque limiter 27, installed on the support plate 20 via the mounting plate 28, passes through the shaft 13; a joining member 26 which is joined to this torque limiter 27 is fixed in place. That is, the torque limiter 27 is provided between the joining member 26 fixed to the shaft 13, and the mounting plate 28, which is non-rotatable.

Further, a torque limiter 120 is mounted on the tape take-up drum 12 supported by the shaft 13, via the mounting plate 122, and in a state of being passed through the shaft 13. The joining member 121 which is joined to this torque limiter 120 is fixed to the shaft 13.

The torque limiter 27 allows the shaft 13 to rotate only upon receiving either rotational torque from the motor 39 during paper currency payout, or rotational torque due to tension of the tape T caused by winding onto the paper currency accumulation drum 10 during paper currency storage. That is, the torque limiter 27 does not allow the shaft 13 to rotate, except when necessary during storage or payout. When the outer diameters of the paper currency accumulation drum 10 and of the tape take-up drum 12 change considerably due to wrapping of tape T and paper currency S and the difference between the respective rotation speeds is large, the torque limiter 120 causes slipping to occur between the shaft 13 and the tape take-up drum 12, absorbing the difference in speed. By this means, a difference in rotation speed due to changes in outer diameter can be absorbed without performing special gear ratio modifications or similar, and the tension of the tape T can be kept constant; moreover, excessive loads are not applied to the tape T even during sudden impacts due to paper currency jams and similar.

A shaft 109 is supported by the side plate 19, support plate 20 and by the step plate portion 201 of the side plate 21, in an orientation perpendicular to these, so as to enable rotation. Moreover, shafts 49 and 108 are supported by the support plate 20, in an orientation perpendicular to this, and the shaft 49 is able to rotate with respect to the support plate 20, whereas the shaft 108 is fixed with respect to the support plate 20.

A gear 103 is fixed to the shaft 49 in the portion on the side of the accumulation space 23. This gear 103 is made to mesh with a gear 34 of the motor 39 similarly positioned on the side of the accumulation space 23. On the portion of this shaft 49 on the side of the driving system space 22 is installed an electromagnetic clutch 100, and a gear 104 is provided via this electromagnetic clutch 100. That is, the driving force of the motor 39 is transmitted to the electromagnetic clutch 100 via the gears 34 and 103 and the shaft 49. When the electromagnetic clutch is put into the on state, the shaft 49 rotates integrally with the gear 104, and when in the off state the shaft 49 is idle with respect to the gear 104.

On the portion of the fixed shaft 108 on the side of the driving system space 22 is provided, via the electromagnetic clutch 102, a gear 105; this gear 105 is made to mesh with the gear 104. By putting the electromagnetic clutch 102 in the off state the gear 105 is put into the free state, and when in the on state the gear 105 is fixed with respect to the fixed shaft 108, and applies a brake so as to quickly cause stoppage.

A gear 106, meshed with the gear 105, is fixed onto the portion of the shaft 109 on the side of the driving system space 22. Further, a manually operated handle pulley 112 is fixed to the portion of the shaft 109 on the outer side from the step plate portion 201.

On the portion of the shaft 11 on the side of the driving system space 22 is provided, via a one-way clutch 31, a toothed pulley, in a manner enabling rotation. On the portion of the shaft 13 on the side of the driving system space 22 is provided, via a one-way clutch 33, a toothed pulley 32, in a manner enabling rotation; and a toothed timing belt 38 is installed over these.

When a driving force is applied to the geared pulley 30 through the timing belt 38 in the winding direction to cause integral rotation of the geared pulley 30, shaft 11 and paper currency accumulation drum 10 to wind the tape T, the one-way clutch 31 is in the locked state, such that the geared pulley 30 rotates integrally with the shaft 11. When a driving force is applied in the payout direction (the direction opposite the above take-up direction) to the geared pulley 30 by the timing belt 38 so as to cause rotation in the payout direction of tape T, the one-way clutch 31 puts the shaft 11 into the free state with respect to the geared pulley 30.

When a driving force is applied to the geared pulley 32 through the timing belt 38 in the winding direction to cause integral rotation of the geared pulley 32, shaft 13 and ape take-up drum 12 to wind the tape T, the one-way clutch 33 is in the locked state, such that the geared pulley 32 rotates integrally with the shaft 13. When a driving force is applied in the payout direction (the direction opposite the above take-up direction) to the geared pulley 32 by the timing belt 38 so as to cause rotation in the payout direction of tape T, the one-way clutch 33 puts the shaft 13 into the free state with respect to the geared pulley 32.

The timing belt 38 is also applied to a pulley 35 provided to apply tension to the timing belt 38. The support member 36 supports the pulley 35 in a manner enabling rotation, and is installed on the support plate 20. In this support member 36 are provided two long mounting holes 37; by adjusting the position of installation within the range of the long mounting holes 37, the tension of the timing belt 38 can be adjusted.

As shown in FIG. 2, the sensors 40*a*, 40*b* for accumulated paper sheet detection are positioned such that the sensor optical paths pass through the groove 14 for the sensor optical path provided in the paper currency accumulation drum 10. These accumulated paper sheet detection sensors 40*a*, 40*b* perform residual detection to determine whether paper currency S is accumulated by (wrapped around) the paper currency accumulation drum 10. The reason for providing two accumulated paper sheet detection sensors 40*a*, 40*b* is that, because the outer-circumference length of the paper currency accumulation drum 10 is larger than the long-side length of the smallest paper currency S, if there is only one sensor, there is the possibility that when the paper currency accumulation drum 10 is stopped the presence or absence of paper currency S wrapped around the paper currency accumulation drum 10 cannot be completely detected. When the outer circumference length of the paper currency accumulation drum 10 is equal to or less than the length of the long side of the smallest paper currency S, then the presence or absence of paper currency S can be completely detected even by a single accumulated paper sheet detection sensor. Further, if control is executed such that the paper currency accumulation drum 10 is rotated somewhat and a broad extent of the outer circumference is within the sensor optical path, the presence or absence of paper currency S can be detected by even a single accumulated paper sheet detection sensor.

Further, an optical passage confirmation sensor 41 which detects the passage of paper currency S is provided in a position close to and on the outside of the upper roller 3 and lower roller 4 in the inlet/outlet 2. By means of this passage confirmation sensor 41, the number of pieces of paper currency S which have been stored or paid out is counted, and the timing for control of each of the electromagnetic clutches 100, 102 is detected.

In addition, between the lower roller 4 and the paper currency accumulation drum 10 is provided an optical-type first end detection sensor 95, which, by detecting a detection portion, not shown, formed on the tape T, detects the fact that the tape T paid out from the paper currency accumulation drum 10 has ended. As the detection portion formed on the tape T, for example, when the tape is formed primarily from a semi-transparent resin material, a portion or the entirety may be opaque and colored or similar. Detection portions may also be provided corresponding respectively to the end of the tape T paid out from the paper currency accumulation drum 10, to a location near this end, to the end of the tape T paid out from the tape take-up drum 12, and to a location near this end.

A tape end detection portion 44, which detects the fact that the tape T paid out from the tape take-up drum 12 has reached the end, is provided near the tape take-up drum 12. This tape end detection portion 44 has a shaft 43, a tape end detection arm 45, a roller 46, a tension spring 48, and an optical-type second end detection sensor 42. The shaft 43 is placed parallel to the shaft 13 near the tape take-up drum 12. The tape end detection arm 45 is provided with this shaft 43 at the center so as to enable oscillation. The roller 46 is provided parallel to the shaft 43, at the end of the tape end detection arm 45 opposite the shaft 43. The tension spring 48 impels the tape end detection arm 45 in the direction to cause contact of the roller 46 with the outermost circumference on the outermost side of the tape T wrapped around the tape take-up drum 12 (the counterclockwise direction in FIG. 2 and FIG. 3). When tape is paid out from the tape take-up drum 12 until near-end is reached, the end detection sensor 42 detects the sensor blocking portion 47 formed in the tape end detection arm 45.

Tape T which had been wrapped around the tape take-up drum 12 is paid out upon operation to store paper currency S, and as the outer circumference of the tape T which had been wrapped around the tape take-up drum 12 decreases in diameter, the tape end detection arm 45, which is causing the roller 46 to be in contact with this outer circumference, gradually oscillates about the shaft 43, being driven by the diameter of the outermost circumference, through the spring force of the tension spring 48. When the sensor blocking portion 47 of the tape sensor detection arm portion 45 blocks the optical path of the second end detection sensor 42, the second end detection sensor 42 detects the fact that the tape T has been paid out from the tape take-up drum 12 up to near the end.

In place of this tape end detection portion 44, a sensor blocking portion 97 and accumulation portion full detection sensor 96 provided in the base member 55 of the above-described paper currency separation mechanism 51 may be used, to detect from the tape take-up drum 12 that the tape T has been paid out to near the end. That is, the sensor blocking portion 97 of the base member 55 judges that near the end has been reached when a fixed position has been passed. Here, the accumulation portion full detection sensor 96 corresponds to the position of the outer circumference of the paper currency accumulation drum 10, including the tape T and paper currency S which have been wrapped together thereonto, and so even if the tape T along has been wrapped onto the paper currency accumulation drum 10 without accumulating paper currency S, there is the possibility that the tape T may all be paid out from the tape take-up drum 12 before detection by the accumulation portion full detection sensor 96 of the sensor blocking portion 97. However, in such a case a sensor to detect the sensor blocking portion 97 is positioned at a position at which near the end of the tape T can be detected when, as in this case, only tape T is wrapped around paper currency accumulation drum 10 without accumulating paper currency S, and when this position is exceeded, near-end is detected. In this case, of course, combined use with the first end detector sensor 95 is necessary.

In this aspect, opaque detection portions are provided on semitransparent tape T, such that a first end detection sensor 95 can detect the end of the tape T on the side of the paper currency accumulation drum 10 and the end on the side of the tape take-up drum 12, and the first end detection sensor 95 detects the detection portion for end detection on the side of the tape take-up drum 12. When the second end detection sensor 42 of the tape end detection portion 44 detects the sensor blocking portion 47, the tape T is confirmed to be the end portion with respect to the tape take-up drum 12. On the other hand, when the detection portion for end detection on the side of the paper currency accumulation drum 10 is detected by the first end detection sensor 95, and moreover the second end detection sensor 42 of the tape end detection portion 44 does not detect the sensor blocking portion 47, the tape T is confirmed to be at the end portion with respect to the paper currency accumulation drum 10.

Normally, each time there is a command to store paper currency S, paper currency S is accumulated in the paper currency accumulation drum 10, and upon detection that the paper currency accumulation drum 10 is full, a control portion, not shown, ascertains the number of pieces of paper currency. In the event that an unanticipated situation occurs, and the full state of the paper currency accumulation drum 10 is detected by the accumulation portion full detection sensor 96, or when the end of the tape T is detected by the first end detection sensor 95 or the second end detection sensor 42 for the table T, operation is halted immediately.

A rotation count detection plate 235 is fixed to the support shaft 234 of the lower roller 4. This rotation count detection plate 235 is detected by the rotation count detection sensor 9 positioned in proximity thereto, so that the number of rotations of the lower roller 4 is detected. A control portion, not shown, computes the transport speed (the speed of travel of the tape T) of paper currency S at the inlet/outlet 2 based on the number of rotations of the lower roller 4 detected by this rotation count detection sensor 9, and controls the rotation speed of the motor 39 such that the transport speed of paper currency S is a prescribed constant value.

During storage of paper currency S, the electromagnetic clutch 100 of the shaft 49 is turned on, the electromagnetic clutch 102 of the shaft 108 is turned off, and the motor 39 is made to rotate in the paper currency storage direction. The rotational force from the motor 39 imparts rotation, via the timing belt 38, to the shaft 11 in the paper currency storage direction (the clockwise direction in FIG. 2 and FIG. 3). By this means, the paper currency accumulation drum 10 rotates in the paper currency storage direction (the clockwise direction in FIG. 2 and FIG. 3) via the torque limiter 17, to wind tape and paper currency S. Through this motion, the tape T is driven in rotation by the tape take-up drum 12 and shaft 13.

At this time, the outer diameter of the paper currency accumulation drum 10 gradually grows larger as tape T and paper currency S are wrapped around the drum, and the outer diameter of the tape take-up drum 12, which pays out tape T, gradually grows smaller. The difference in drum rotation speeds grows large as the difference between the outer diameters of the drums 10 and 12 increases; but this difference is absorbed by the action of the torque limiter 120 provided between the shaft 13 and the tape take-up drum 12. By this means, gearing problems and similar are prevented.

At the time take-up by the paper currency accumulation drum 10 ends, that is, when the passage confirmation sensor 41 detects that paper currency has been stored in the quantity to be stored, the electromagnetic clutch 100 of the shaft 49 is turned off, and the driving force from the motor 39 is interrupted. In concert with this, by turning on the electromagnetic clutch 102 of the shaft 108, braking is applied to the timing belt 38, and by means of the torque limiter 17 on the support plate 20, the shaft 11 and paper currency accumulation drum 10 are halted. By this means, the tape take-up drum 12, which had been driven in rotation via the tape T, is halted by the torque limiter 27 on the support plate 20.

On the other hand, at the time of paper currency payout the electromagnetic clutch 100 of the shaft 49 is turned on, the electromagnetic clutch 102 of the shaft 108 is turned off, and when the motor 39 is caused to rotate in the paper currency payout direction, the rotational force from the motor 39 is applied, via the timing belt 38, to rotate the shaft 13 in the paper currency payout direction (the counterclockwise direction in FIG. 2 and FIG. 3). By this means, the tape take-up drum 12 is rotated in the paper currency payout direction (the counterclockwise direction in FIG. 2 and FIG. 3) via the torque limiter 27, and winds tape T. Via the tape T, the paper currency accumulation drum 10 and shaft 11 are driven in rotation.

At this time, the outer diameter of the tape take-up drum 12 gradually increases as tape T is wrapped thereabout, while the outer diameter of the paper currency accumulation drum 10 gradually decreases as tape T and paper currency S are paid out. As the difference between the outer diameters increases, the difference in rotation speeds also grows large, but this difference is absorbed by the action of the torque limiter 110 provided between the shaft 11 and paper currency accumulation drum 10. Hence gearing problems and similar are prevented.

When winding by the tape take-up drum 12 ends, that is, when the passage confirmation sensor 41 detects that paper currency has been paid out in the quantity to be paid out, the electromagnetic clutch 100 of the shaft 49 is turned off, and the driving force from the motor 39 is interrupted. In concert with this, by turning on the electromagnetic clutch 102 of the shaft 108, braking is applied to the timing belt 38, and by means of the torque limiter 27 of the support plate 20, the shaft 13 and tape take-up drum 12 are halted. By this means, the paper currency accumulation drum 10, which had been driven in rotation via the tape T, is halted by the torque limiter 17 of the support plate 20. At this time, the accumulated paper currency detection sensors 40*a*, 40*b* notify a higher-level control portion, not shown, of the fact that there is no paper currency in the paper currency accumulation drum 10.

The paper currency storage and payout device 1 of this aspect, configured as described above, may for example be used as a temporary storage portion in a paper currency insertion/ejection equipment. In this case, operation is as follows.

The paper currency storage and payout device 1 being used as a temporary storage portion in paper currency insertion/ejection equipment stores paper currency inserted by the operator into the paper currency insertion/ejection equipment, in a state of a mixture of monetary types, until a deposit confirmation command is received.

An operation to deposit money, such as insertion of paper currency S or similar, is performed by the operator, and when a counting operation is begun (when a start button is pressed or similar), a higher-level control portion, not shown, takes the inserted paper currency S into the equipment, and issues operation commands to the transport system to perform differentiation, counting, temporary storage, rejection, and similar. At the same time, a driving command for rotation in the paper currency storage direction is issued to the motor 39 of the paper sheet storage and payout device 1, and the motor 39 is caused to rotate. At this time, the electromagnetic clutch 100 and the electromagnetic clutch 102 are turned off, so that driving is not transmitted to the shaft 11 or the shaft 13, and driving from the motor 39 causes only the gear 103 of the shaft 49 to rotate idly.

Thereafter, upon confirmation, by a sensor not shown in the transport path 50, that paper currency to be stored temporarily has arrived in the vicinity of the inlet/outlet 2 via the transport path 50, a higher-level control portion, not shown, turns on the electromagnetic clutch 100 and transmits the driving of the motor 39 to the shaft 11. Then the driving of the motor 39 is conveyed to the shaft 11 via the timing belt 38, and the paper currency accumulation drum 10 rotates in the paper currency storage direction (the clockwise direction in FIG. 2 and FIG. 3). Then tape T is gradually paid out from the tape take-up drum 12 and wound onto the paper currency accumulation drum 10. At this time, paper currency S sent from the inlet/outlet 2, separated into individual bills and to be stored temporarily, is placed onto the inlet/outlet region Ta of the tape T by the upper roller 3 and lower roller 4 while being wrapped around the paper currency accumulation drum 10 together with the tape T. At this time, paper currency S which has advanced from the inlet/outlet 2 is guided by the intake-side guide surface 231 of the guide portion 225 of the separator 56, and smoothly enters between the separator 56 and the inlet/outlet region Ta of the tape T. The paper currency S then is wrapped around the paper currency accumulation drum 10 while receiving the transport force toward the paper currency accumulation drum 10 from the transport roller 71, which is driven in rotation via the guide roller 70 accompanying rotation of the paper currency accumulation drum 10.

When the trailing-end portion of paper currency S the leading end of which has been wrapped around the paper currency accumulation drum 10 passes the passage confirmation sensor 41, a higher-level control portion, not shown, turns off the electromagnetic clutch 100 and turns on the electromagnetic clutch 102, so that driving of the motor 39 is not transmitted to the shaft 11, and in addition braking is applied to the timing belt 38. Then, through the action of the torque limiter 17, rotation of the shaft 11 is quickly halted. Each time paper currency which has been temporarily stored is confirmed by a sensor, not shown, in the transport path 50, the above operation is repeated.

When all the inserted paper currency S has been stored in the paper sheet storage and payout device 1 or has been returned to the operator as rejected paper currency, a higher-level control portion, not shown, displays on a display portion, not shown, the monetary amount of paper currency which has been temporarily stored, and at the same time prompts the operator to perform subsequent processing to either confirm deposit of the temporarily stored paper currency, or to cancel processing. When confirming the deposit, the operator performs an operation to confirm the deposit, and when canceling processing performs an operation to cancel processing, upon which a higher-level control portion, not shown, issues a command to initiate the respective processing. That is, the transport system of the paper currency insertion/ejection equipment is driven, a command to perform driving in the paper currency payout direction is issued to the motor 39, and rotation of the motor 39 is begun. The electromagnetic clutch 100 is turned on, and driving of the motor 39 is transmitted to the shaft 13.

Then, the driving of the motor 39 is transmitted to the shaft 13 via the timing belt 38, and the tape take-up drum 12 rotates in the paper currency payout direction (the counterclockwise direction in FIG. 2 and FIG. 3). In this way, the tape T and paper currency are successively paid out from the paper currency accumulation drum 10, and only the tape T is wrapped around the tape take-up drum 12. At this time, due to the action of the paper currency separation promotion mechanism 80 on paper currency paid out from the paper currency accumulation drum 10, wrinkles are formed in the paper currency S along the paper currency transport direction, and the separation tip portion 224 of the separator 56 of the paper currency separation mechanism 51 enters into the portion of the wrinkles of the paper currency S, separation of which from the paper currency accumulation drum 10 has been promoted. As a result, the paper currency S is reliably separated from the wrapping peripheral region Tb of the tape T which had been wrapped around the paper currency accumulation drum 10, and is guided from the inlet/outlet region Ta of the tape T by the payout-side guide surface 232 of the guide portion 225 of the separator 56, and transported to the inlet/outlet 2. At this time, with rotation of the paper currency accumulation drum 10, transport power is applied to the paper currency S on the side of the inlet/outlet 2 by the transport roller 71, which is driven in rotation via the guide roller 70.

In this way, paper currency S which had been stored in the paper currency accumulation drum 10 is paid out from the inlet/outlet 2 and passed over to the transport path 50, and only the tape T is wrapped around the tape take-up drum 12.

In the case of a deposit confirmation operation, the paper currency S passes again through a differentiation portion or similar, not shown, and upon confirming the monetary amount, is transported to storage portions by monetary type; whereas in the case of cancellation, the paper currency is transported to a money ejection aperture of the paper currency insertion/ejection equipment.

When the end of the tape T on the side of the paper currency accumulation drum 10 is detected by the first end detection sensor 95 and second end detection sensor 42, a higher-level control portion, not shown, turns off the electromagnetic clutch 100 and turns on the electromagnetic clutch 102, so that driving of the motor 39 is not transmitted to the shaft 13. Then, the action of the torque limiter 27 causes rotation of the shaft 13, that is, the tape take-up drum 12, to be halted quickly.

According to the paper sheet storage and payout device 1 of the aspect described above, by means of a sliding portion 222 which, by causing the guide roller 70 to make contact with the wrapping peripheral region Tb of the tape T, the diameter of which changes with the amount wrapped on the paper currency accumulation drum 10, tracks the amount of tape T wrapped, the separator 56 which separates paper currency S from the wrapping peripheral region Tb of the tape T is held. Hence compared with cases of oscillation, the amount of change in the angle of the separator 56 with respect to the wrapping peripheral region Tb of the tape T when the amount of tape T wrapped around the paper currency accumulation drum 10 changes can be kept small. Hence smooth separation of paper currency S from the wrapping peripheral region Tb of the tape T can be performed stably. Moreover, the sliding portion 222 tracks the amount of wrapping of tape T by causing the guide roller 70 to make contact with the wrapping peripheral region Tb of the tape T, the diameter of which changes with the amount wrapped on the paper currency accumulation drum 10. Hence sliding to track the amount of tape T wrapped can be accomplished by means of a simple structure.

The sliding portion 222 slides in a direction which always intersects the payout direction of tape T from the paper currency accumulation drum 10, regardless of the amount of tape T wrapped around the paper currency accumulation drum 10. By this means, in cases in which sliding is possible in the direction parallel to the payout direction of the tape T, the amount of change in the angle of the separator 56 with respect to the wrapping peripheral region Tb of the tape T can be kept small when there is a change in the amount of tape T wrapped around the paper currency accumulation drum 10. Moreover, when the amount of tape T wrapped around the paper currency accumulation drum 10 changes, the amount of change in the distance of the separation tip portion 224 of the separator 56 and the payout starting position P of the tape T can also be kept small. In this aspect, as shown in FIG. 8 to FIG. 10, even when the amount of tape T wrapped around the paper currency accumulation drum 10 changes over the range from the smallest to the largest amounts, the angle β made by the payout starting position P of the tape T and the separation tip portion 224 of the separator 56 is substantially constant, being held with the range of, for example, 20 to 30°, and more specifically, is set so that the angle is substantially constant at 24°. Hence smooth separation of paper currency S from the wrapping peripheral region Tb of the tape T can be performed reliably. In this case, the sliding direction of the sliding portion 222 is set so that the angle of intersection γ with the line of extension of the inlet/outlet 2, that is, with a horizontal line, is 20°.

Further, the sliding portion 222 is impelled by the tension springs 57, 58 in the center direction of the paper currency accumulation drum 10, so that the guide roller 70 can be caused to slide so as to be in contact with the wrapping peripheral region Tb of the tape T, the diameter of which changes according to the amount wrapped, by means of a simple structure.

Moreover, because the separator 56 is capable of oscillation, even when there are minute vibrations in the sliding direction of the guide roller 70 due to the thickness of the paper currency S, the separation tip portion 224 of the separator 56 can be held in contact with the wrapping peripheral region Tb of the tape T. Hence even when the sliding portion 222 is made to slide by the guide roller 70, smooth separation of paper currency S from the wrapping peripheral region Tb of the tape T can be performed stably. Further, the separator 56 is provided with a guide portion 225 which guides paper currency S separated by the separation tip portion 224 to the downstream side, so that separated paper currency S can be reliably guides to the downstream side.

Further, the separator 56 is impelled by the tension spring 67 to bring the separation tip portion 224 into contact with the wrapping peripheral region Tb of the tape T, so that by means of a simple structure, the separation tip portion 224 can be held in contact with the wrapping peripheral region Tb of the tape T even when the sliding portion 222 undergoes minute vibrations.

Moreover, the transport roller 71 provided in the paper currency separation portion 79 transports paper currency S separated from the tape T to the downstream side; because this transport roller 71 is in contact with and driven in rotation by the guide roller 70, rotation of the paper currency accumulation drum 10 can be transmitted via the guide roller 70 to the transport roller 71 to transport the paper currency S. Hence a driving source to drive the transport roller 71 is not necessary, so that the structure is simpler, more compact, and less expensive.

Further, the paper currency separation promotion mechanism 80 provided near the paper currency separation portion 79 and upstream in the direction of payout of paper currency makes contact with the paper currency S furthest on the payout side among the paper currency S wrapped around the paper currency accumulation drum 10, and promotes the separation of this paper currency S from the wrapping peripheral region Tb of the tape T. Hence smooth separation of paper currency S from the wrapping peripheral region Tb of the tape T by the paper currency separation portion 79 provided on the downstream side can be performed still more stably.

In addition, by means of the pair of separation promotion rollers 85 and 86 of the paper currency separation promotion mechanism 80, which are inclined such that the further downstream in the payout direction of paper currency S placed on both sides of the tape T, the narrower is the interval therebetween, the paper currency S is gathered toward the tape side on both sides, so that wrinkles are formed along the payout direction on the tape side T, the paper currency S rises from the wrapping peripheral region Tb of the tape T, and separation is promoted. By means of such a simple structure, separation of paper currency from the wrapping peripheral region Tb of the tape T can be promoted.

In the paper currency separation promotion mechanism 80, the base member 84 holds the pair of separation promotion rollers 85, 86 and is supported by the arm member 81 so as to enable rotation. The base member 84 is driven to rotate around the shaft 83 in a counterclockwise direction in FIG. 5 by the tension spring 90 with respect to the arm member 81. The arm member 81 is driven to rotate around the shaft 82 (FIG. 3) in a clockwise direction in FIG. 5 by the tension spring 91 (FIG. 3) toward the paper currency accumulation drum 10. As a result the pair of separation promotion rollers 85, 86 moves so as to track the amount of paper currency wrapped around the paper currency accumulation drum 10. Thus through a simple structure, the pair of separation promotion rollers 85, 86 can be moved so as to track the amount of paper currency wrapped around the paper currency accumulation drum 10.

Further, when for example only tape T is wrapped around the paper currency accumulation drum 10, without storing paper currency S, the diameter of only the wrapping peripheral region Tb of the tape T becomes large, without a change in the positions of the pair of separation promotion rollers 85, 86 on both sides of the tape E. Even in this state, the auxiliary roller 87 provided in the base member 84 is in contact with the wrapping peripheral region Tb and maintains an interval between the wrapping peripheral region Tb and the base member 84. Hence contact between the tape T and the base member 84 can be prevented.

The paper sheet storage and payout device 1 of this aspect can also be used as, for example, the storage portion of paper currency insertion/ejection equipment. In this case, operation is as follows. When the paper currency is handled separately by monetary type, a plurality of devices are provided, according to the monetary types. This paper sheet storage and payout device 1 stores paper currency, insertion of which has been confirmed, by monetary type, and upon receiving an ejection command, pays out the necessary number of paper currency bills one at a time.

With respect to operation upon insertion, after operations by the operator from insertion of money to confirmation of insertion have been performed, a higher-level control portion, not shown, issues an instruction to transport the paper currency, insertion of which has been confirmed, to the paper sheet storage and payout device 1. Simultaneously with this, commands to drive rotation in the paper currency storage direction are issued to the motors 39 of all of the plurality of paper sheet storage and payout devices 1, causing the motors 39 to rotate. At this time, the electromagnetic clutch 100 and electromagnetic clutch 102 are turned off, so that driving is not transmitted to the side of the shaft 11 or shaft 13, and driving from the motor 39 causes only the gears 103 of the shaft 49 to rotate idly.

Thereafter, when a sensor, not shown, of the transport path 50 confirms that the relevant monetary type of paper currency passes through the transport path 50 within proximity of the inlet/outlet 2, a higher-level control portion, not shown, turns on the electromagnetic clutch 100 so that the driving of the motor 39 is transmitted to the shaft 11. Then, the driving of the motor 39 is transmitted via the timing belt 38 to the shaft 11, and the paper currency accumulation drum 10 rotates in the paper currency storage direction (the clockwise direction in FIG. 2 and FIG. 3). The tape T is then paid out from the tape take-up drum 12 in succession, and is wrapped around the paper currency accumulation drum 10. At this time, the paper currency S to be stored, which is sent from the inlet/outlet 2 separated into individual bills, is placed onto the inlet/outlet region Ta of the tape T by the upper roller 3 and lower roller 4 and is wrapped onto the paper currency accumulation drum 10 together with the tape T. At this time, paper currency S which has advanced from the inlet/outlet 2 is guided by the intake-side guide surface 231 of the guide portion 225 of the separator 56, and smoothly enters between the separator 56 and the inlet/outlet region Ta of the tape T. The paper currency S then is wrapped around the paper currency accumulation drum 10 while receiving a transport force in the direction of the paper currency accumulation drum 10 from the transport roller 71, which is driven in rotation via the guide roller 70, accompanying rotation of the paper currency accumulation drum 10.

When the trailing end of paper currency S the leading end of which has been wrapped around the paper currency accumulation drum passes the passage confirmation sensor 41, a higher-level control portion, not shown, turns off the electromagnetic clutch 100 and turns on the electromagnetic clutch 102, so that driving of the motor 39 is not transmitted to the shaft 11 and braking is applied to the timing belt 38. Then, through the action of the torque limiter 17, rotation of the shaft 11 is quickly halted. Each time paper currency of the monetary type in question is confirmed by a sensor, not shown, in the transport path 50, the above operation is repeated.

On the other hand, with respect to operation upon ejection of money, after an operation for ejection of money is performed by an operator, a higher-level control portion, not shown, issues a command to pay out the required number of bills of paper currency S to be ejected from the relevant paper sheet storage and payout device 1. That is, the transport system of each of the portions of the paper currency insertion/ejection equipment is driven, and in addition a command for driving in the paper currency payout direction is issued to the motor 39, causing the motor 39 to rotate. The electromagnetic clutch 100 is turned on, and driving of the motor 39 is transmitted to the shaft 13.

Then, driving by the motor 39 is transmitted via the timing belt 38 to the shaft 13, and the tape take-up drum 12 rotates in the paper currency payout direction (the counterclockwise direction in FIG. 2 and FIG. 3). In this way, tape T and paper currency S are paid out in succession from the paper currency accumulation drum 10, and only tape T is wrapped around the tape take-up drum 12. At this time, due to the action of the paper currency separation promotion mechanism 80, wrinkles are formed in the paper currency S paid out from the paper currency accumulation drum 10, along the paper currency transport direction on the side of the tape T. The paper currency S separation from the paper currency accumulation drum 10 of which has been promoted in this way is reliably separated from the wrapping peripheral region Tb of the tape T wrapped around the paper currency accumulation drum 10, and is guided by the payout-side guide surface 232 of the guide portion 225 of the separator 56 into the inlet/outlet region Ta and transported into the inlet/outlet 2. At this time, a transporting force into the inlet/outlet 2 is applied to the paper currency S by the transport roller 71 which is driven in rotation via the guide roller 70 by rotation of the paper currency accumulation drum 10.

In this way, the paper currency S stored in the paper currency accumulation drum 10 is paid out from the inlet/outlet 2 and passed to the transport path 50, and only the tape T is wrapped around the tape take-up drum 12.

When the passage confirmation sensor 41 confirms that all the paper currency to be ejected has been paid out from the paper sheet storage and payout device 1, a higher-level control device, not shown, turns off the electromagnetic clutch 100 and turns on the electromagnetic clutch 102, so that driving of the motor 39 is not transmitted to the shaft 13. Then, the action of the torque limiter 27 causes the rotation of the shaft 13, that is, of the tape take-up drum 12, to halt quickly.

Upon operation to eject money, when the accumulated paper currency detection sensors 40*a*, 40*b* detect that paper currency is no longer present in the paper currency accumulation drum 10, the paper currency accumulation drum 10 is assumed to be empty and further ejection is halted, and this fact is conveyed to the operator by display on a display portion or similar, or by other means. In actuality, a higher-level control portion, not shown, ascertains the number of paper currency bills stored in the paper currency accumulation drum 10, so that at the time that the operator is performing operations for money ejection (specifying a monetary amount for ejection and similar), a higher-level control portion, not shown, is judging whether a money ejection operation is possible; if not possible, the operator is informed in advance of this fact by a display portion or similar, not shown, so that a short of paper currency during an ejection operation does not occur.

As explained above, in this invention a separation member which separates paper sheet from the wrapping peripheral region of tape is held by a sliding portion which slides to track the amount of tape wrapped around a second take-up drum, and which causes contact of a guide roller in the wrapping peripheral region of the tape, the diameter of which changes with the amount wrapped on the second take-up drum. Hence the amount of change in the angle of the separation member with respect to the wrapping peripheral region of the tape in the wrapping peripheral region can be kept small, when the amount of tape wrapped on the second tape take-up drum changes.

Hence smooth separation of paper sheets from the wrapping peripheral region of tape can be performed stably. Further, because a sliding portion causes a guide roller to be in contact with the wrapping peripheral region of the tape, the diameter of which changes according to the amount wrapped on the second take-up drum, the amount of tape wrapped is tracked, and so a simple structure can be used to effect sliding which tracks the amount of tape wrapped.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A paper sheet storage and payout device comprising:

a first take-up drum which winds tape from one end;

a second take-up drum which winds the tape with paper sheets placed thereupon from the other end, and stores and pays out paper sheets by causing winding and unwinding of the tape with the first take-up drum; and a separation mechanism which is provided on the tape payout side of the periphery of the second take-up drum, and includes a separation member which at the time of payout of paper sheets separates the paper sheets from the wrapping peripheral region of the tape wrapped around the second take-up drum, and a sliding portion which holds the separation member and slides tracking the amount of tape wrapped around the second take-up drum by causing a guide roller to be into contact with the wrapping peripheral region;

wherein said separation mechanism includes a transport roller which is in contact with and driven in rotation by said guide roller, and which rotates in the same direction as said second take-up drum to transport said paper sheets.

2. The paper sheet storage and payout device according to claim 1, wherein a separation promotion mechanism is provided in proximity to said separation mechanism and on the upstream side in the paper sheet payout direction in a manner enabling motion to track the amount of paper sheets wrapped around said second take-up drum, said separation promotion mechanism being in contact with the paper sheets closest to the payout side among the paper sheets wrapped around said second take-up drum, and promoting the separation of the paper sheets from said wrapping peripheral region.

3. The paper sheet storage and payout device according to claim 2, wherein said separation promotion mechanism has a pair of separation promotion rollers positioned on both sides of said tape, and inclined such that the further on the downstream side in the paper sheet payout direction, the narrower is the interval therebetween.

4. The paper sheet storage and payout device according to claim 3, wherein said separation promotion mechanism has a base member which holds said pair of separation promotion rollers;

an arm member, capable of oscillation, which supports the base member in a manner enabling oscillation;

a base impelling member which impels said base member with respect to said arm member so as to bring said pair of separation promotion rollers into proximity with said second take-up drum; and an arm impelling member which impels said arm member in a direction so as to bring said pair of separation promotion rollers into proximity with said second take-up drum.

5. The paper sheet storage and payout device according to claim 4, wherein said separation promotion mechanism comprises an auxiliary roller supported by said base member, said auxiliary roller maintaining an interval between the wrapping peripheral region and said base member through contact with said wrapping peripheral region.

6. The paper sheet storage and payout device according to claim 1, wherein said sliding portion slides in a direction which always intersects the tape payout direction from said second take-up drum, regardless of said amount of tape wrapped.

7. The paper sheet storage and payout device according to claim 6, wherein said separation member is supported by said sliding portion so as to enable oscillation, said separation member including a separation tip portion which is in contact with said wrapping peripheral region so as to separate paper sheets from the wrapping peripheral region, and a guide portion which guides paper sheets separated by said separation tip portion to the downstream side.

8. The paper sheet storage and payout device according to claim 7, wherein said separation member is impelled by an impelling member in a direction to cause contact of said separation tip portion with said wrapping peripheral region.

9. The paper sheet storage and payout device according to claim 1, wherein said sliding portion is impelled by an impelling member toward the center of said second take-up drum.

10. The paper sheet storage and payout device according to claim 9, wherein said separation member is supported by said sliding portion so as to enable oscillation, said separation member including a separation tip portion which is in contact with said wrapping peripheral region so as to separate paper sheets from the wrapping peripheral region, and a guide portion which guides paper sheets separated by said separation tip portion to the downstream side.

11. The paper sheet storage and payout device according to claim 10, wherein said separation member is impelled by an impelling member in a direction to cause contact of said separation tip portion with said wrapping peripheral region.

12. The paper sheet storage and payout device according to claim 1, wherein said separation member is supported by said sliding portion so as to enable oscillation, said separation member including a separation tip portion which is in contact with said wrapping peripheral region so as to separate paper sheets from the wrapping peripheral region, and a guide portion which guides paper sheets separated by said separation tip portion to the downstream side.

13. The paper sheet storage and payout device according to claim 12, wherein said separation member is impelled by an impelling member in a direction to cause contact of said separation tip portion with said wrapping peripheral region.

14. A paper sheet storage and payout device comprising:

a first take-up drum which winds tape from one end;

a second take-up drum which winds the tape with paper sheets placed thereupon from the other end, and stores and pays out paper sheets by causing winding and unwinding of the tape with the first take-up drum; and a separation mechanism which is provided on the tape payout side of the periphery of the second take-up drum, and includes a separation member which at the time of payout of paper sheets separates the paper sheets from the wrapping peripheral region of the tape wrapped around the second take-up drum, and a sliding portion which holds the separation member and slides tracking the amount of tape wrapped around the second take-up drum by causing a guide roller to be into contact with the wrapping peripheral region;

wherein a separation promotion mechanism is provided in proximity to said separation mechanism and on the upstream side in the paper sheet payout direction in a manner enabling motion to track the amount of paper sheets wrapped around said second take-up drum, said separation promotion mechanism being in contact with the paper sheets closest to the payout side among the paper sheets wrapped around said second take-up drum, and promoting the separation of the paper sheets from said wrapping peripheral region;

wherein said separation promotion mechanism has a pair of separation promotion rollers positioned on both sides of said tape, and inclined such that the further on the downstream side in the paper sheet payout direction, the narrower is the interval therebetween.

15. The paper sheet storage and payout device according to claim 14, wherein said separation promotion mechanism has a base member which holds said pair of separation promotion rollers;

an arm member, capable of oscillation, which supports the base member in a manner enabling oscillation;

a base impelling member which impels said base member with respect to said arm member so as to bring said pair of separation promotion rollers into proximity with said second take-up drum; and an arm impelling member which impels said arm member in a direction so as to bring said pair of separation promotion rollers into proximity with said second take-up drum.

16. The paper sheet storage and payout device according to claim 15, wherein said separation promotion mechanism comprises an auxiliary roller supported by said base member, said auxiliary roller maintaining an interval between the wrapping peripheral region and said base member through contact with said wrapping peripheral region.

17. The paper sheet storage and payout device according to claim 14, wherein said sliding portion slides in a direction which always intersects the tape payout direction from said second take-up drum, regardless of said amount of tape wrapped.

18. The paper sheet storage and payout device according to claim 14, wherein said sliding portion is impelled by an impelling member toward the center of said second take-up drum.

19. The paper sheet storage and payout device according to claim 14, wherein said separation member is supported by said sliding portion so as to enable oscillation, said separation member including a separation tip portion which is in contact with said wrapping peripheral region so as to separate paper sheets from the wrapping peripheral region, and a guide portion which guides paper sheets separated by said separation tip portion to the downstream side.

20. The paper sheet storage and payout device according to claim 19, wherein said separation member is impelled by an impelling member in a direction to cause contact of said separation tip portion with said wrapping peripheral region.

* * * * *